US008414095B2

(12) United States Patent
Stewart

(10) Patent No.: US 8,414,095 B2
(45) Date of Patent: Apr. 9, 2013

(54) FULL EXTENSION REFRIGERATOR SHELF AND BASKET SYSTEM

(75) Inventor: Brian Joseph Stewart, Vincennes, IN (US)

(73) Assignee: SSW Holding Company, Inc., Fort Smith, AK (US)

( * ) Notice: Subject to any disclaimer, the term of this patent is extended or adjusted under 35 U.S.C. 154(b) by 61 days.

(21) Appl. No.: 12/358,458

(22) Filed: Jan. 23, 2009

(65) Prior Publication Data

US 2009/0188877 A1 Jul. 30, 2009

Related U.S. Application Data

(60) Provisional application No. 61/023,061, filed on Jan. 23, 2008.

(51) Int. Cl.
*A47B 96/04* (2006.01)

(52) U.S. Cl.
USPC ..... 312/408; 108/108

(58) Field of Classification Search ..... 312/408, 312/410, 404, 401; 108/108
See application file for complete search history.

(56) References Cited

U.S. PATENT DOCUMENTS

| | | | | | |
|---|---|---|---|---|---|
| 2,103,885 | A * | 12/1937 | Whalen | 312/404 |
| 2,187,916 | A * | 1/1940 | Seeger | 312/404 |
| 2,207,115 | A * | 7/1940 | Carr | 312/246 |
| 2,239,369 | A * | 4/1941 | Nauert | 312/408 |
| 3,169,813 | A * | 2/1965 | Cannon et al. | 312/404 |
| 4,735,470 | A * | 4/1988 | Falk | 312/408 |
| 5,403,083 | A * | 4/1995 | Dasher et al. | 312/408 |
| 5,403,084 | A * | 4/1995 | Kane et al. | 312/408 |
| 5,429,433 | A | 7/1995 | Bird | |
| 5,454,638 | A | 10/1995 | Bird | |
| 5,564,809 | A | 10/1996 | Kane | |
| 5,735,589 | A | 4/1998 | Herrmann | |
| 5,813,741 | A * | 9/1998 | Fish et al. | 312/408 |
| 5,980,009 | A * | 11/1999 | Atalla et al. | 312/408 |
| 6,120,720 | A | 9/2000 | Meier | |
| 2003/0117051 | A1 * | 6/2003 | Kweon | 312/408 |
| 2004/0183417 | A1 * | 9/2004 | Ahmed et al. | 312/408 |
| 2006/0255704 | A1 * | 11/2006 | Grobleben et al. | 312/408 |
| 2007/0252498 | A1 * | 11/2007 | Wing | 312/408 |

* cited by examiner

*Primary Examiner* — Hanh V Tran
(74) *Attorney, Agent, or Firm* — Varnum, Riddering, Schmidt & Howlett LLP

(57) ABSTRACT

A shelf assembly (1020) in a refrigerator (1002) includes a refrigerator shelf (1022). Also included is a cantilever frame (1028) to slidably support the shelf (1022). The shelf assembly (1020) includes a left side hanger set (1042) extending rearwardly from the cantilever frame (1028). A right side rear bracket extension (1044) extends directly to the right from the right end and the rear portion of the cantilever frame (1028). The rear bracket extension (1044) provides for an offset of the refrigerator shelf (1022) from one side of the refrigerator (1002). The offset provides that when the shelf (1022) is extended forwardly, the front end of the shelf (1022) will not be interfered with by any portion of the refrigerator door when the door is in an open position.

6 Claims, 33 Drawing Sheets

FULL EXTENSION REFRIGERATOR SHELF AND BASKET SYSTEM

CROSS-REFERENCE TO RELATED APPLICATIONS

This application claims priority of U.S. Provisional Patent Application Ser. No. 61/023,061 on Jan. 23, 2008.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The invention relates to shelving designs which may be adapted for use with refrigerators and other articles employing shelving and, more particularly, refrigerator shelving and baskets having the capability of obtaining full extension from a rested position without interference from conventional refrigerator doors.

2. Background Art

Previous types of shelving have been developed for use as refrigerator and other shelves. In designing refrigerator shelving, it is important to provide a means for permitting selected movement of the shelf within the refrigerator, in addition to providing adequate support for the shelf.

Numerous shelving designs exist in the prior art. For example, Kane, et al., U.S. Pat. No. 5,564,809, issued Oct. 14, 1996, discloses an encapsulated shelf assembly with a shelf support supporting a panel. The panel has an edge and a one-piece member encapsulating the panel edge and a substantial majority of the shelf support. The shelf assembly may be formed in a mold apparatus which defines a mold cavity and uses a spacing plug to position the shelf support in a mold cavity of the apparatus in a location spaced from the sides of the mold cavity.

Herrmann, et al., U.S. Pat. No. 5,735,589, issued Apr. 7, 1998, discloses a shelf assembly for a refrigerator compartment which includes a member slidably supported for extension and retraction on a support. The shelf member includes slide members which are preferably molded as a rim on an article support surface. A guide member extends from at least one, and preferably both, of the side members to guide the sliding movement. A stop on the guide member limits travel by engaging a limit surface on the shelf support.

Bird, et al., U.S. Pat. No. 5,454,638, issued Oct. 3, 1995, discloses adjustable refrigerator shelving having a shelf rail for supporting a partial width shelf within a refrigerator compartment on first and second, spaced shelf racks vertically oriented in the compartment. The tracks releasably engage with a number of support brackets for cantilever support of one or more shelves at a plurality of vertically spaced locations. The shelf rail includes rearwardly projecting hooks at each of the two opposing ends for releasable engagement with the shelf tracks. Locking tabs are included on the hooks to retain the shelf rails on the track, while a rub strip is provided between the partial shelf and the shelf rail, along a top edge of the shelf rail.

Bird, et al., U.S. Pat. No. 5,429,433, issued Jul. 4, 1995, describes a refrigerator shelf which is adapted for containment of spills on the shelf. The shelf includes a planer shelf member with a rim molded around the perimeter edge of the shelf member to form a liquid tight seal between the rim and the shelf member. The molded rim projects above the top surface of the shelf member to form a liquid dam for containing spills on the shelf member. In one embodiment, the shelf is slidably mounted to allow horizontal extension of the shelf, with access to the rear portion of the shelf using slide guides molded into the rim along each side of the shelf. The shelf is cantilevered upon support brackets from the rear wall of a refrigerator to allow air flow around the shelf sides. The support brackets are adapted to support the shelf at a plurality of vertical positions.

Meier, et al., U.S. Pat. No. 6,120,720, issued Sep. 19, 2000, discloses a method of manufacturing a glass shelf with a plastic edge. The glass panel is placed on a cavity of a mold with a peripheral edge of the cavity corresponding to the peripheral edge of the glass panel. The cavity has side cavity portions, each housing one of the shelf brackets. Plastic material is injected into the cavity adjacent corners, so that the forces of the injected material are essentially self balancing around the peripheral edge of the glass panel. In this manner, the glass panel is maintained in a substantially mating conformity with the cavity to produce a relatively consistently contoured frame.

The foregoing is merely a sample of the various types of prior art references which currently exist with respect to refrigerator shelving.

Certain problems particularly exist with any type of refrigerator shelving or baskets which are intended to be extended from a fully retracted position to an extended position. When attempting to obtain full extension of shelving and baskets within a refrigerator compartment, it is common that features on the refrigerator door will not allow the shelving or baskets to obtain full extension from the rested position. Accordingly, it would be advantageous to have shelving and basket configurations which are designed so as to be fully extendable and eliminate the need to make changes to refrigerator door features that currently prohibit shelving or baskets from sliding to a fully extended position.

SUMMARY OF THE INVENTION

In accordance with the invention, a shelf assembly adapted for use in a refrigerator includes at least one shelf secured within an interior of the refrigerator. The shelf is movable between a retracted position and an extended position, for purposes of facilitating placement and removal of articles on the shelf by a user. A cantilever frame is secured in a stationary manner within the refrigerator interior, and is coupled to the refrigerator shelf so as to slidably support the shelf as the shelf moves between retracted and extended positions.

First side hanger means are coupled to the cantilever frame, for purposes of removably securing the cantilever frame to the refrigerator interior. A second side rear bracket extension extends outwardly from a rear portion of the shelf assembly and further extends from a second side of the shelf assembly opposing the first side of the shelf assembly. The second side rear bracket extension essentially provides for an offset of the refrigerator shelf from one side or end of the refrigerator interior. The second side rear bracket extension is sized and configured so as to provide for the offset, so that when the refrigerator shelf is extended forwardly relative to the cantilever frame, a front end of the shelf will not abut or otherwise be interfered with by any portion of the door of the refrigerator, when the door is in an open position.

The second side rear bracket extension is sized and configured so that the offset provides for a functional space existing between the second side of the shelf and a side of the refrigerator interior. The shelf assembly can include a rack positioned adjacent the second side of the shelf within the functional space. The rack can consist of a can rack having a rectangular and horizontally disposed configuration. A can rack can include a set of support wires having a substantially parallel configuration, with the support wires extending downwardly from a rear portion to a front portion of the can rack. In this manner, a can will always be positioned within the forwardmost position of the can rack. The rack can also include a wine rack.

In accordance with another aspect of the invention, a basket assembly is adapted for use in a refrigerator or similar enclosure. The basket assembly includes at least one basket secured within an interior of the refrigerator, so as to be movable between retracted and extended positions. This facilitates placement and removal of articles within the basket by a user. The basket assembly includes a first side arm having a first side hanger set positioned at a rear portion of the first side arm. The first side hanger set is removably coupled to an interior of the refrigerator. The first side arm provides for a slidable engagement between the side arm and the baskets. A second side arm is also coupled to the basket for providing a slidable engagement with the basket. A second side rear bracket extension extends outwardly from the second side opposing the first side. This extension provides for the basket to be offset from one side of the refrigerator interior. A second side hanger set is connected to the second side arm and is removably coupled to the refrigerator interior. The second side rear bracket extension provides for an offset of the basket relative to the side of the refrigerator. This prevents a front portion of the basket from otherwise being interfered with during forward movement by components of the door of the refrigerator.

BRIEF DESCRIPTION OF THE SEVERAL VIEWS OF THE DRAWING

The invention will now be described with reference to the drawings, in which.

DETAILED DESCRIPTION OF THE INVENTION

The principles of the invention are disclosed, by way of example, in certain embodiments of shelving and basket assemblies, as illustrated in FIGS. 41-53. As described in subsequent paragraphs herein, the shelving and basket assemblies provide for fully extendable shelving and basket units that eliminate the need to make changes to refrigerated door features which currently prohibit known shelving and basket assemblies for refrigerators from sliding outwardly to fully extended position. More specifically, and as also described in greater detail herein, the shelf and basket assemblies employ an offset on a side of the assemblies which would normally interfere with the refrigerator door not permitting the shelf or basket assembly to be extended fully. The offset allows for the shelf or basket assembly to extend to its full, extendable length, without hitting the refrigerator door. In the area of the offset, an added feature can be provided which allows the customer to place different items which would remain stationery as the shelf or basket is extended. The shelf or basket assembly may be provided with ball bearing slide elements, so as to allow full extension.

For purposes of describing background with respect to refrigerator shelves, certain refrigerator shelving units which have the capability of slidable extension will first be described herein with respect to FIGS. 1-40. This disclosure in subsequent paragraphs herein with respect to FIGS. 1-40 is set forth in commonly owned International Application Serial No. PCT/US03/24713, titled Heat Staked Shelf and filed Aug. 8, 2003.

Figure 1:
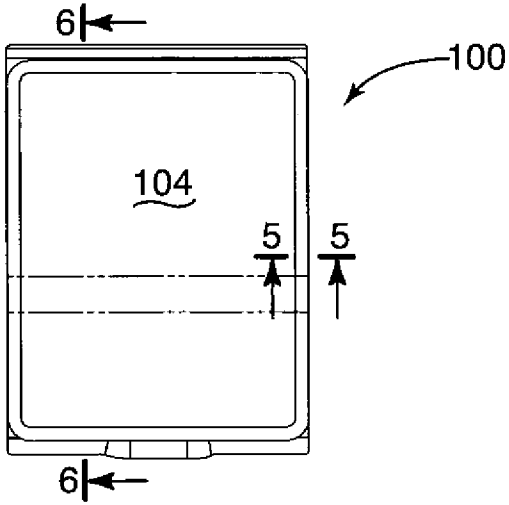
FIG. 1 is a plan view of a first embodiment of a shelving assembly.
Figure 2:
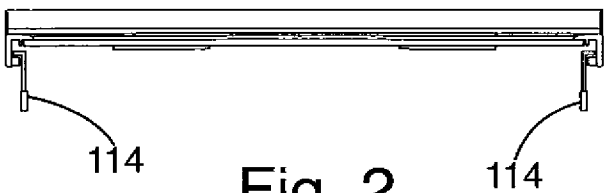
FIG. 2 is a rear elevation view of the embodiment of the shelving assembly as shown in FIG. 1.

Turning to FIGS. 1-40, a first embodiment of a shelving assembly disclosed in the afore-referenced patent application is a shelving assembly 100 as illustrated in plan view in FIG. 1 and is further illustrated in FIGS. 2-9. Referring specifically to FIGS. 1-9, the shelving assembly 100 includes a cantilever or metal frame 102 (see FIG. 8). Although this particular embodiment of a shelving assembly as illustrated in FIGS. 1-9 utilizes a metal frame 102, it should be emphasized that other embodiments of shelving assemblies may consist of a shelving assembly without a metal frame 102. Such an assembly is shown, for example, in the shelving assembly as illustrated in FIGS. 13-19. Such an embodiment will be described in subsequent paragraphs herein. Returning to FIGS. 1-9, the metal frame 102 is used in part to support a glass shelf or glass shelf panel 104. In addition, the metal frame 102 is also used in part to support a plastic rim 106, which is also part of the shelving assembly 100. As described in subsequent paragraphs herein the glass shelf panel 104 may be secured to the plastic rim 106 through the use of an adhesive (described in subsequent paragraphs) throughout the entirety of the periphery of the glass shelf panel 104.

Figure 8:
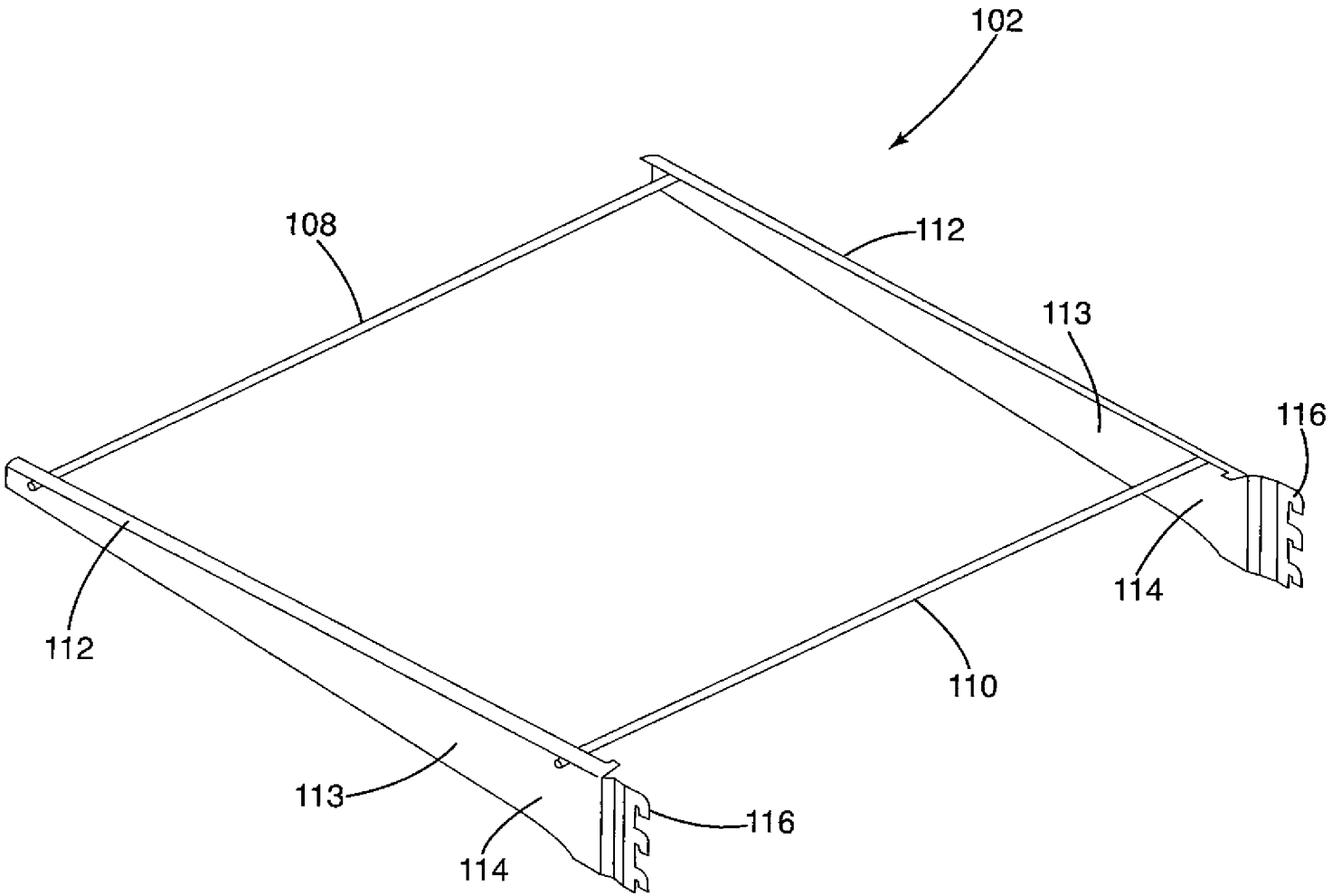
FIG. 8 is a perspective view of a metal cantilever frame which may be employed with the first embodiment of the shelving assembly.

Returning to the metal frame 102, and referring primarily to FIG. 8, the metal frame 102 includes a forward and substantially horizontally disposed frame member 108. In addition, another substantially horizontally disposed frame member 110 is positioned to the rear of the metal frame 102. These frame members are coupled by any suitable means (not shown) to a pair of opposing and parallel sideplates 114. The sideplates 114 may include downwardly projecting side members 113. In addition, projecting outwardly from the upper portion of the downwardly side member 113 are outwardly projecting members or flanges 112. These outwardly projecting members 112 will serve purposes as described in subsequent paragraphs herein. Each of the sideplates 114 may include a hanger set 116 extending rearwardly from the corresponding sideplate 114. The hanger set 116 may be utilized as cantilever brackets of relatively conventional design, so as to removably lock the shelving assembly 100 into tracks (not shown) connected to walls of refrigerators or other assemblies to which the shelving assembly 100 is to be attached.

Figure 7:
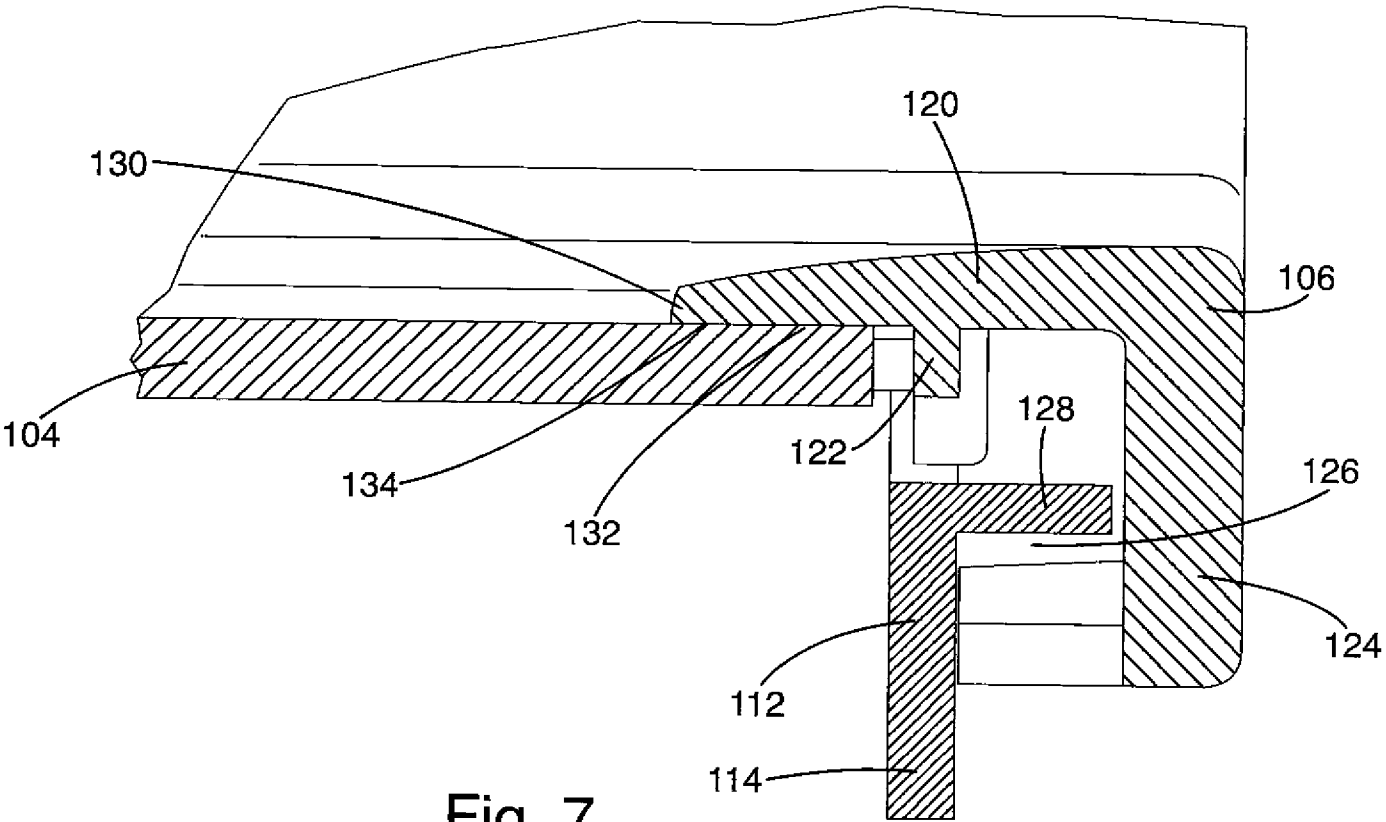
FIG. 7 is an enlarged view of the first embodiment of the shelving assembly and consisting of an enlargement of FIG. 5.
Figure 11:
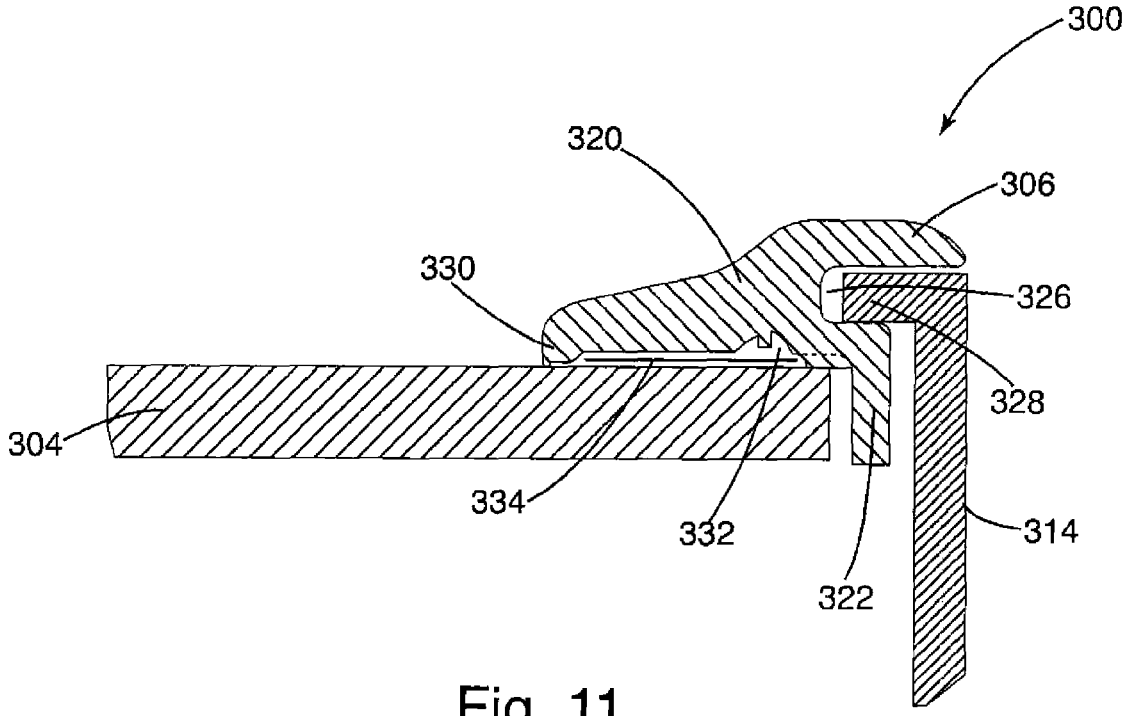
FIG. 11 is a cross-sectional view similar in perspective and content to the views of FIGS. 7 and 10, and illustrates an additional embodiment of a partial shelving assembly and particularly directed to the feature of employing an inwardly projecting sideplate with the shelving assembly.
Figure 12:
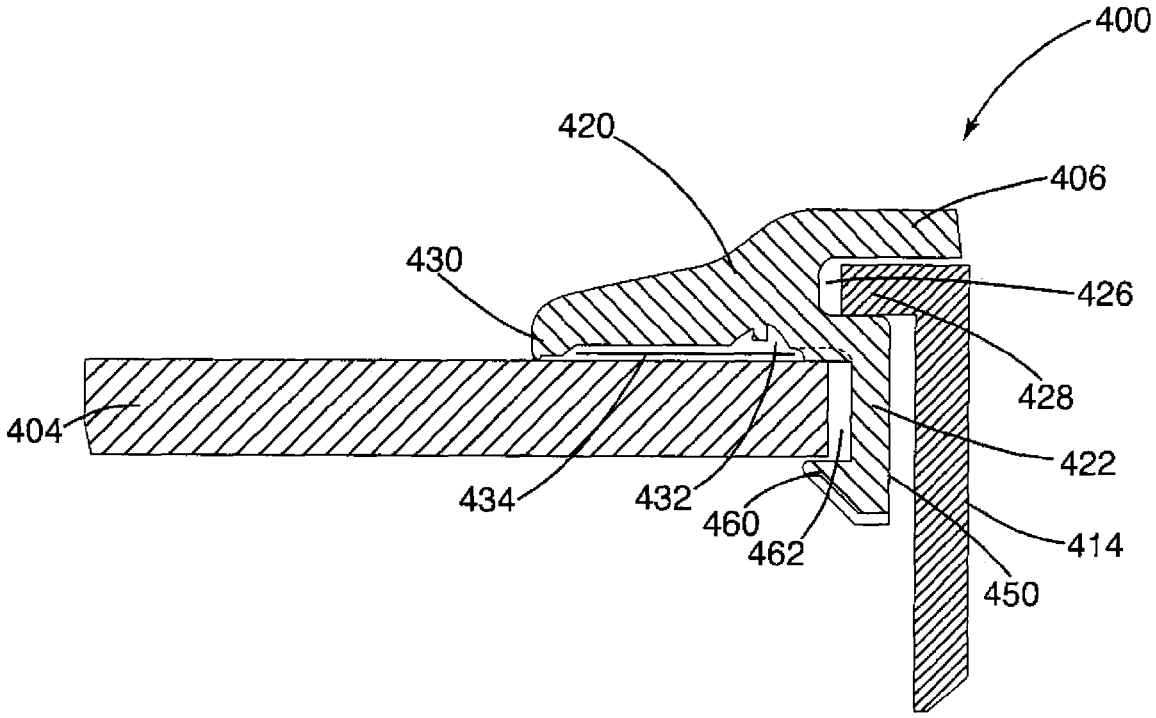
FIG. 12 is a similar view of a partial structure embodiment of the shelving assembly as illustrated in FIG. 11, and showing the relative position of one of the snap features.
Figure 15:
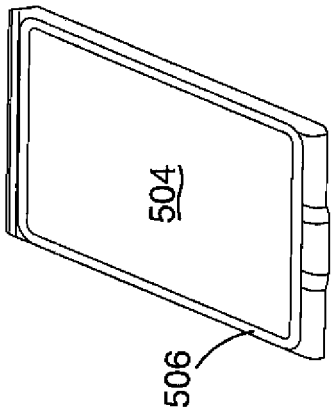
FIG. 15 is a perspective view of the embodiment of the shelving assembly as shown in FIG. 13.
Figure 14:
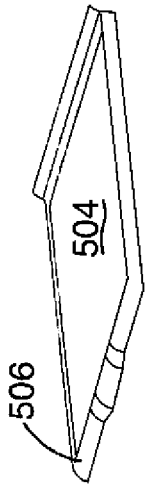
FIG. 14 is a side elevation view of the embodiment of the shelving assembly as shown in FIG. 13.
Figure 13:
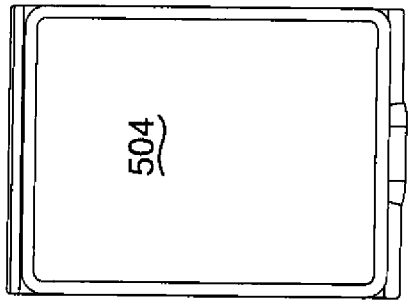
FIG. 13 illustrates a plan view of a non-cantilever or metal frame embodiment of a shelving assembly.

The glass shelf or glass shelf panel 104, and the plastic rim 106, may be appropriately supported on the metal frame 102. As shown primarily in FIG. 4, the plastic rim 106 will extend around the entirety of the periphery of the glass shelf or glass shelf panel 104. In this particular embodiment, the plastic rim 106 will have a cross-sectional configuration as primarily illustrated in FIGS. 5 and 7. More specifically, the plastic rim 106 includes a horizontally disposed section 120. Extending downwardly, and integral with the horizontally disposed section 120, is a downwardly projecting section 122. Also extending downwardly, and integral with the horizontally disposed section 120, is another downwardly projecting section 124. The combination of the horizontally disposed section 120, downwardly projecting section 122, and downwardly projecting section 124, forms a slide space 126. Turning again to the sideplate 114, and as illustrated in FIG. 7, the sideplate 114 may include an outwardly projecting section 128, which may be received within the slide space 126. The outwardly projecting section 128 may correspond with the horizontally disposed and outwardly directed flange or member 112 previously described with respect to FIG. 8. Other embodiments of shelving assemblies may utilize an inwardly projecting member or a completely "flat" sideplate 114. An inwardly projecting member is shown, for example, in the shelving assembly as illustrated in FIGS. 11 and 12. A "flat" sideplate is shown, for example, in the shelving assembly as illustrated in FIGS. 20-25. "Inwardly projecting sideplates" and "flat sideplate" embodiments will be described in subsequent paragraphs herein.

Figure 4:
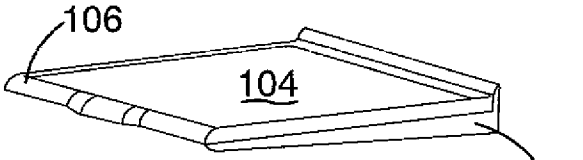
FIG. 4 is a perspective view of the first embodiment of the shelving assembly as shown in FIG. 1.
Figure 3:
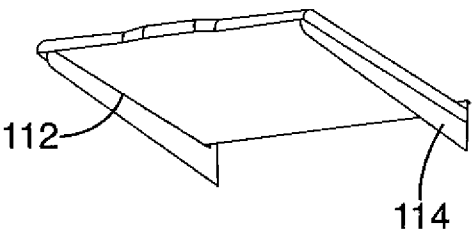
FIG. 3 is an underneath side elevation view of the first embodiment of the shelving assembly shown in FIG. 1.
Figure 5:
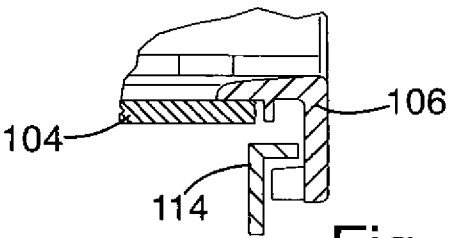
FIG. 5 is a sectional, elevation view taken along section lines 5-5 of FIG. 1, illustrating certain principles of interconnection of elements of the shelving assembly.

As earlier stated, the plastic rim 106 includes a substantially horizontally disposed section 120, again as illustrated in FIGS. 5 and 7. As also earlier stated, the plastic rim 106 extends around the entirety of the periphery of the shelving assembly 100. The horizontally disposed section 120 projects inwardly and terminates in a downwardly projecting lip 130, again as illustrated primarily in FIG. 7. As further illustrated in FIG. 7, the relative structure of the downwardly projecting lip 130 provides for a spacial area 132 formed between the lower surface of the horizontally disposed section 120 and the upper surface of the glass shelf panel 104. Within this spacial area 132, an appropriate adhesive 134 is provided within the spacial area 132, and is utilized to facilitate securing of the glass shelf panel 104 to the plastic rim 106. This adhesive 134 may be utilized around the entire periphery of the glass shelf or glass shelf panel 104. In addition to providing a means for securing the glass shelf panel 104 to the plastic rim 106, the adhesive 134 also acts as a leak-proof barrier, preventing spillage from seeping down to lower shelves or other surfaces around the periphery of the glass shelf panel 104. Further, with the use of the adhesive 134, as opposed to traditional encapsulation and sonic welding procedures, build up of food and spills (with resultant bacteria) do not occur within crevices that are substantially incapable of being cleansed. In substantial part, the unitary design of the plastic rim 106 provides these advantages.

Figure 9:
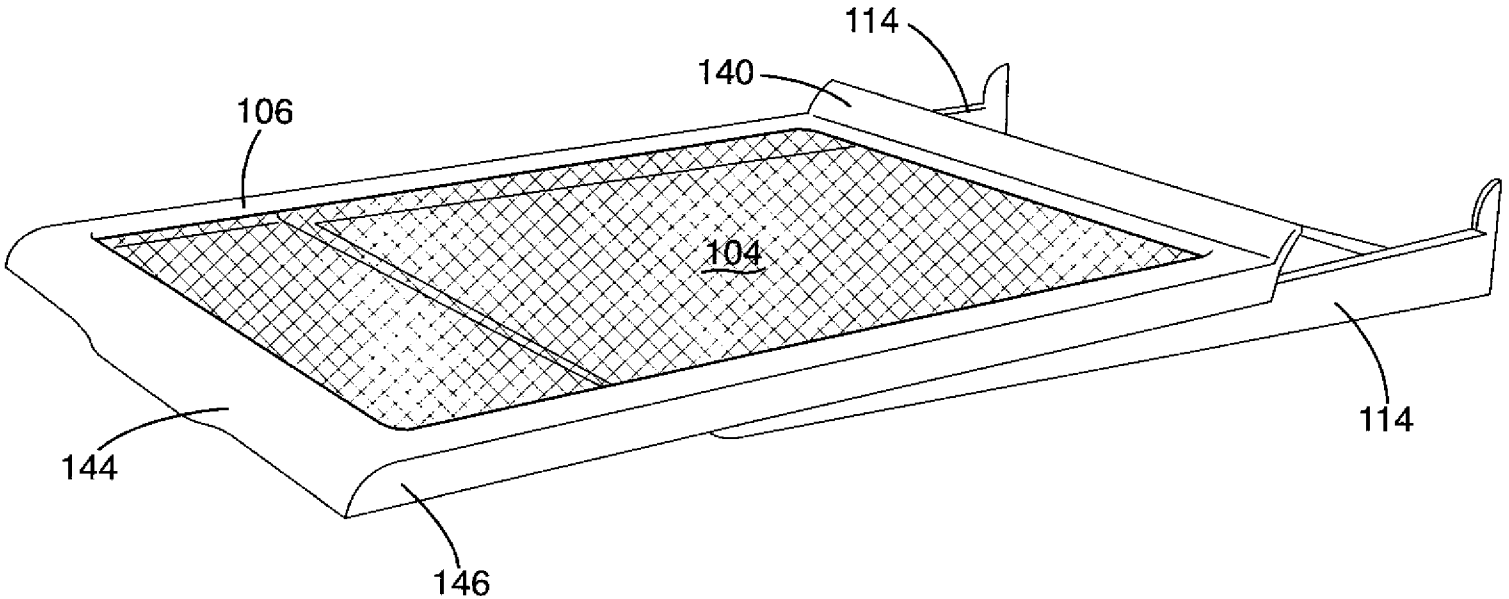
FIG. 9 is a perspective view of the first embodiment of the shelving assembly illustrating the sliding feature of the glass shelf relative to the metal frame.

As earlier stated, the glass shelf or glass shelf panel 104, interconnected with the plastic rim 106, may have capability of sliding relative to the metal frame 102. The sliding action can occur through the relative coupling of the outwardly projecting member 128 of the sideplate 114 to the plastic rim 106 through the slide space 126. The shelving assembly 100 with the glass shelf 104 and plastic rim 106 in a relatively extended position is illustrated in FIG. 9. As will be described in subsequent paragraphs herein, the shelving assemblies may include "stop" designs having the capability of preventing the glass shelf panel 104 and plastic rim 106 from completely sliding "out of" the metal frame 102. Certain embodiments of "stop" designs are described in subsequent paragraphs.

The plastic rim 106 also includes other structural configurations at forward and rearward locations of the shelving assembly 100. For example, and as primarily illustrated in FIG. 6, the plastic rim 106 may include an upwardly projecting "backstop" 140 extending across the entirety of the rear portion of the plastic rim 106. The plastic rim 106 may also include a downwardly projecting member 142 extending across the rear portion or around the entire underside of the shelving assembly 100, as is desired. Downwardly projecting member 142 also acts as a positioning aid for the glass shelf panel 104 during manufacturing. As previously described, the plastic rim 106 is of a single, unitary design. Therefore, the upwardly projecting backstop 140 and downwardly projecting member 142 are integral with the remaining portions of the plastic rim 106.

Figure 6:
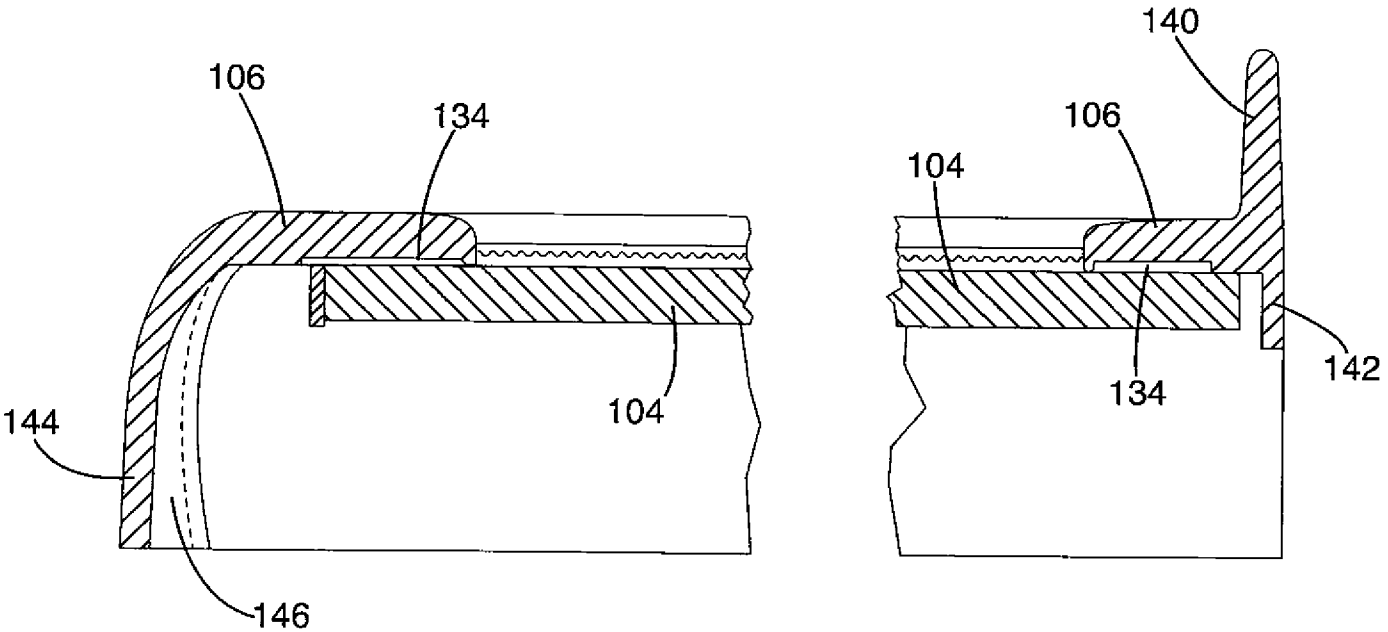
FIG. 6 is a side sectional view taken substantially through the middle of the first embodiment of the shelving assembly, along section lines 6-6 of FIG. 1, with the sectional view also partially cut away in the middle.

At the forward area of the plastic rim 106, the plastic rim 106 includes a downwardly projecting forward lip 144, having an arcuate cross section as illustrated in FIG. 6. The downwardly projecting lip 144 acts in part as a "bumper" to prevent damage of shelving assembly 100 from articles which may be "knocked against" the forward portion of the shelf assembly 100. In addition to the "bumper" features of the projecting lip 144, the projecting lip 144 may also act as a manually operable handle, so that a user may slide the shelf panel 104 and plastic rim 106 forward or rearward of the metal frame 102, for purposes of extending and retracting the assembly, respectively. The forward portion of the plastic rim 106 may also include side members 146 (see FIGS. 6 and 9), again for purposes of protection. The first embodiment of a shelving assembly has now been described with respect to shelf assembly 100. In particular, the shelf assembly 100 includes an integrally formed plastic rim 106, glass shelf panel 104 and metal frame 102. As previously described, an adhesive 134 facilitates securing of the glass shelf panel 104 to the plastic rim 106. In addition, the adhesive 134 acts as a leak-proof barrier against spillage seeping off of the glass shelf panel 104. This adhesive 134, in combination with the unitary structure of the plastic rim 106, also assists in preventing build up of food particles and fluids within cracks or crevices which cannot readily be cleaned. Accordingly, this design also limits build up of bacteria.

Still further, the shelving assembly 100 cuts down material usage and facilitates speeding up of manufacturing processes, in view of the integral design of the plastic rim 106. As previously discussed, the coupling of the glass panel 104 to the plastic rim 106 and the integral construction of the plastic rim 106 significantly differs from current methods of completely encapsulating glass shelving within plastic, or the use of top and bottom pieces of plastic sonically welded around glass. Still further, and as described with respect to the shelving assembly 100, the glass shelf 104 and plastic rim 106 can slide on the metal frame 102. This sliding movement is substantially incapable of being accomplished in encapsulated or sonic welded shelving assembly, without the addition of special add-on hardware or additional plastic molding associated with the shelf.

Various types of adhesives may be employed. To illustrate, two types of adhesives that may be utilized are a polyurethane hot melt or a light cured acrylic adhesive.

Figure 10:
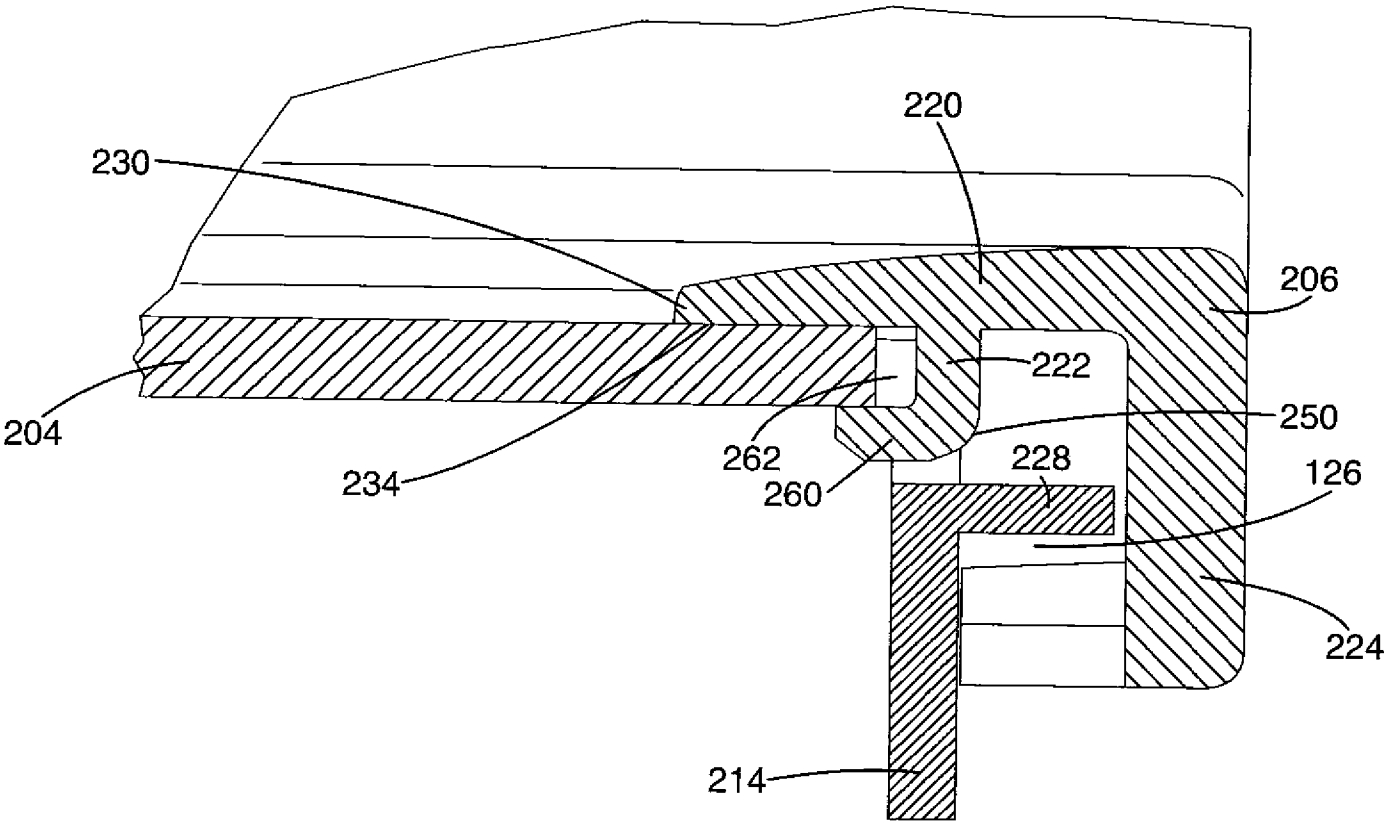
FIG. 10 is a sectional view similar in perspective and structure to FIG. 7, and illustrating a cross-sectional view of a second embodiment of a partial shelving assembly illustrating the interconnection of a plastic rim with snaps and glass, and further illustrating the relationship of these elements with an outwardly projecting sideplate.

A second embodiment of a shelving assembly is illustrated in part as shelving assembly 200 in FIG. 10. For purposes of clarity and brevity, the entirety of the shelf assembly 200 is not illustrated. The shelf assembly 200 is substantially similar in design and construction to shelf assembly 100 previously described with respect to FIGS. 1-9. The distinctions between shelf assembly 100 and shelf assembly 200 are primarily shown in FIG. 10, which is similar in perspective and content to FIGS. 5 and 7 associated with shelf assembly 100. More specifically, with shelf assembly 200, a metal frame is provided which includes a sideplate 214. The sideplate includes an outwardly projecting tab 228 at its upper portion. The outwardly projecting tab 228 is integral with the sideplate 214. The shelving assembly 200 further includes a plastic rim 206, similar in structure and function to the plastic rim 106 also previously described with respect to FIG. 7. The plastic rim 206 includes a horizontally disposed section 220. Extending downwardly, and integral with the horizontally disposed section 220, is a downwardly projecting section 222. Also extending downwardly, and integral with the horizontally disposed section 220, is another downwardly projecting section 224. The combination of the horizontally disposed section 220, downwardly projecting section 222, and downwardly projecting section 224, forms a slide space 226. The sideplate 214 may include an outwardly projecting section 128, which may be received with in the slide space 226. The slide space 226 has the same function as slide space 126 as illustrated in FIG. 7, with respect to shelving assembly 100. That is, the slide space 226 provides for a slidable coupling and support of the plastic rim 206 with the sideplate 214, through the outwardly projecting tab 228 of the sideplate 214. As with the assembly 100, the shelving assembly 200 also includes a spacial area 232 formed between the plastic rim 206 and a glass shelf or glass shelf panel 204, with the plastic rim 206 having a downwardly projecting lip 230. Within the spatial area 232, an adhesive 234 is provided so as to secure and couple together the glass shelf panel 204 and the plastic rim 206. Distinguishable from the shelving assembly 100, the shelving assembly 200 includes one or a series of snaps 250 which may be positioned at various locations on the underside of the front, back, and sides (or combinations thereof) of the plastic rim 206. A snap 250 is formed through the use of a horizontally disposed ledge 260 as illustrated in FIG. 10. The horizontal disposed ledge 260 is preferably formed integral with the downwardly projecting section 222 of the plastic rim 206, at certain positions along the plastic rim 206. The horizontally disposed section 220, downwardly projecting section 222 and horizontally disposed ledge 260 are sized so as to form a slot 262 as shown in FIG. 10. The slot 262 is appropriately sized so as to provide a "snap-fit" coupling of the edge of the glass shelf or glass shelf panel 204 with the snap 250 through the slot 262. The snap 250 may be utilized to provide additional retention and support for the glass shelf or glass shelf panel 204.

Additional features of alternative embodiments of a shelving assembly are illustrated in FIGS. 11 and 12. Referring specifically to FIG. 11, the drawing of FIG. 11 illustrates, in part, an alternate cross-section of the plastic rim 306 utilizing an inwardly projecting sideplate 314. Shelving assembly 300 consists of a plastic rim 306, glass shelf panel 304, and metal frame (not shown for brevity purposes) similar to the metal frame shown in FIG. 8. More specifically, the plastic rim 306 includes a horizontally disposed section 320. Extending downwardly, and integral with the horizontally disposed section 320, is a downwardly projecting section 322. The combination of the horizontally disposed section 320 and the downwardly projecting section 322 forms a slide space 326. The sideplate 314 may include an inwardly projecting section 328, which may be received within the slide space 326.

Similar to the shelving assembly 100 illustrated in FIG. 7, shelving assembly 300 has a plastic rim 306 that extends around the entirety of the periphery of the shelving assembly 300. The horizontally disposed section 320 projects inwardly and terminates in a downwardly projecting lip 330 as seen in FIG. 11. As further illustrated in FIG. 11, the relative structure of the downwardly projecting lip 330 provides for a spacial area 332 formed between the lower surface of the horizontally disposed section 320 and the upper surface of the glass shelf panel 304. Within this spacial area 332, an appropriate adhesive 334 is provided and is utilized to facilitate securing of the glass shelf panel 304 to the plastic rim 306. This adhesive 334 may be utilized around the entire periphery of the glass shelf or glass shelf panel 304. In addition to providing a means for securing the glass shelf panel 304 to the plastic rim 306, the adhesive 334 also acts as a leak-proof barrier, preventing spillage from seeping down to lower shelves or other surfaces around the periphery of the glass shelf panel 304. Further, with the use of the adhesive 334, as opposed to traditional encapsulation and sonic welding procedures, build up of food and spills (with resultant bacteria) do not occur within crevices that are substantially incapable of being cleansed.

The glass shelf or glass shelf panel 304, interconnected with the plastic rim 306, may have capability of sliding relative to the metal frame. The sliding action can occur through the relative coupling of the inwardly projecting member 328 of the sideplate 314 to the plastic rim 306 through the slide space 326. The shelving assembly 300 with the glass shelf 304 and plastic rim 306 could have a similar extended position as previously seen in FIG. 9. Again, as will be described in subsequent paragraphs herein, the shelving assemblies may include "stop" designs having the capability of preventing the glass shelf panel 304 and plastic rim 306 from completely sliding "out of" the metal frame. Certain embodiments of "stop" designs are described in subsequent paragraphs.

An additional embodiment is described as shelving assembly 400 as seen in FIG. 12. For purposes of clarity and brevity, the entirety of the shelf assembly 400 is not illustrated. The shelf assembly 400 is substantially similar in design and construction to shelf assembly 300 previously described with respect to FIG. 11. The distinctions between shelf assembly 300 and shelf assembly 400 are primarily shown in FIG. 12, which is similar in perspective and content to FIGS. 5 and 7 associated with shelf assembly 100. More specifically, with shelf assembly 400, a metal frame is provided which includes a sideplate 414. The sideplate includes an inwardly projecting tab 428 at its upper portion. The inwardly projecting tab 428 is integral with the sideplate 414. The shelving assembly 400 further includes a plastic rim 406, similar in structure and function to the plastic rim 306 also previously described with respect to FIG. 11. The plastic rim 406 includes a horizontally disposed section 420. Extending downwardly, and integral with the horizontally disposed section 420, is a downwardly projecting section 422. The combination of the horizontally disposed section 420 and downwardly projecting section 422, forms a slide space 426. The sideplate 414 may include an inwardly projecting section 428, which may be received with in the slide space 426. The slide space 426 has the same function as slide space 326 as illustrated in FIG. 11, with respect to shelving assembly 300. That is, the slide space 426 provides for a slidable coupling and support of the plastic rim 406 with the sideplate 414, to an inwardly projecting member 428 of the sideplate 414. As with the assembly 300, the shelving assembly 400 also includes a spacial area 432 formed between the plastic rim 406 and a glass shelf or glass shelf panel 404, with the plastic rim 406 having a downwardly projecting lip 430. Within the spatial area 432, an adhesive 434 is provided so as to secure and couple together the glass shelf panel 404 and the plastic rim 406. Distinguishable from the shelving assembly 300, the shelving assembly 400 includes one or a series of snaps 450 which may be positioned at various locations on the underside of the front, back, and sides (or combinations thereof) of the plastic rim 406. A snap 450 is formed through the use of a horizontally disposed ledge 460 as illustrated in FIG. 12. The horizontal disposed ledge 460 is preferably formed integral with the downwardly projecting section 422 of the plastic rim 406, at certain positions along the plastic rim 406. The horizontally disposed section 420, downwardly projecting section 422 and horizontally disposed ledge 460 are sized so as to form a slot 462 as shown in FIG. 12. The slot 462 is appropriately sized so as to provide a "snap-fit" coupling of the edge of the glass shelf or glass shelf panel 404 with the snap 450 through the slot 462, the snap 450 may be utilized to provide additional retention and support for the glass shelf or glass shelf panel 404.

Figure 19:
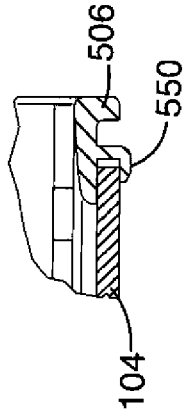
FIG. 19 is a sectional, elevation view taken from the right side of FIG. 17, illustrating the snap feature.
Figure 18:
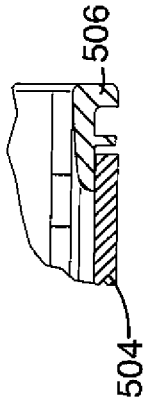
FIG. 18 is a sectional, elevation view taken from the right side of FIG. 16, illustrating certain principles of interconnection of elements of the shelving assembly.
Figure 16:
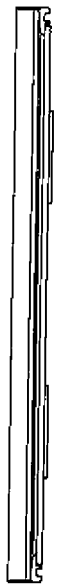
FIG. 16 is a rear elevation view of the shelving assembly as shown in FIG. 13.
Figure 17:
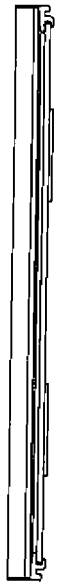
FIG. 17 is a rear elevation view of the shelving assembly as shown in FIG. 13 that utilizes snaps.
Figure 20:
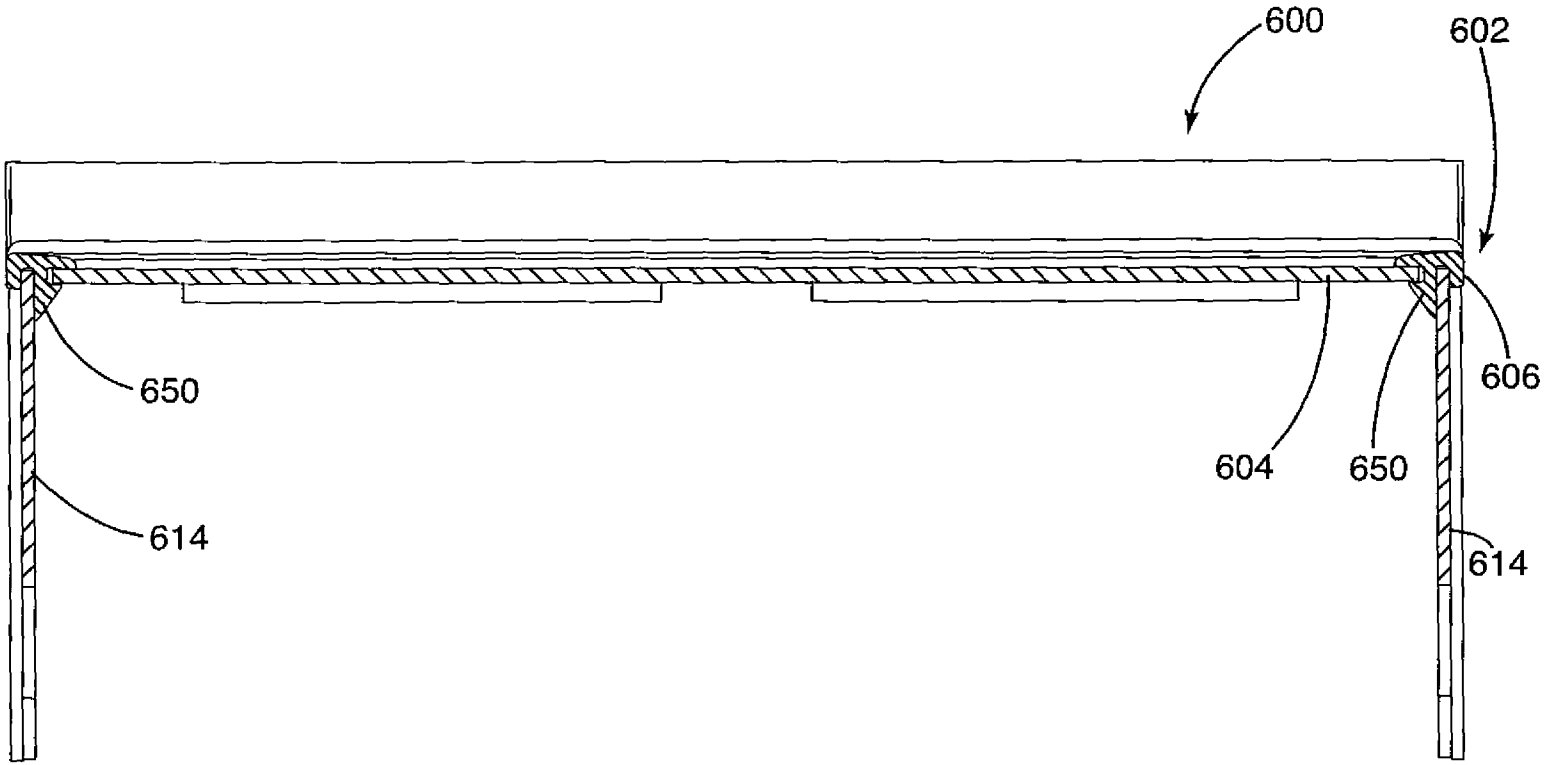
FIG. 20 is a sectional, front elevation view of a further embodiment of a shelving assembly, with this particular shelving assembly having a stationary glass shelf panel and plastic rim, and utilizing flat sideplates.

Additional embodiments are illustrated in FIGS. 13-19. FIGS. 13-19 are embodiments that do not include a cantilever or metal frame 102 as described in FIG. 8. These embodiments utilize similar features as described in shelving assemblies 100, 200, 300, and 400 with the exception of the metal frame. FIGS. 13-19 contain a plastic rim 506 and glass shelf panel 504. The shelving assembly 500 illustrated in FIGS. 13-19 can be placed on various types of support structures such as a ribbed liner of a refrigerator (not pictured) or other similar support structures. For some applications, a metal frame may be rendered useless or unusable with the type of shelving assemblies previously described herein. In those circumstances the shelving assembly 500 without a metal frame as illustrated in FIGS. 13-19 may be utilized. FIG. 16 illustrates a rear view of the shelving assembly 500 and FIG. 18 represents a cross-section of the right side of FIG. 16, similar to FIGS. 7 and 11. FIG. 17 illustrates an additional embodiment showing the rear view of shelving assembly 500 with snaps and FIG. 19 represents a cross-section of the right side of FIG. 17 utilizing snaps 550, similar to FIGS. 10 and 12.

The various embodiments of shelving assemblies which have been described in the foregoing paragraphs have commonality with respect to their capability of exhibiting sliding characteristics for the glass shelf panels. Concepts relating to the use of glass shelf panels with plastic rims interconnected as discussed herein may also be applied to shelving assemblies which maintain the glass shelf panels in a stationary position, relative to surrounding frame structures. For example, a stationary shelving assembly having features is shown in shelving assembly 600, illustrated in FIGS. 20-25. With reference first to FIG. 24, the shelving assembly 600 includes components substantially similar in function and structure to components illustrated and described in prior paragraphs with respect to other shelving assemblies. That is, the shelving assembly 600 includes a metal frame 602, used in part to support a glass shelf or glass shelf panel 604. The metal frame 602 is also used in part to support a plastic rim 606, which is part of the shelving assembly. In a manner previously described herein with respect to other shelving assemblies, the glass shelf panel 604 is preferably secured to the plastic rim 606 with the use of an adhesive (as described in previous paragraphs) throughout the entirety of the periphery of the glass shelf panel 604.

Figure 25:
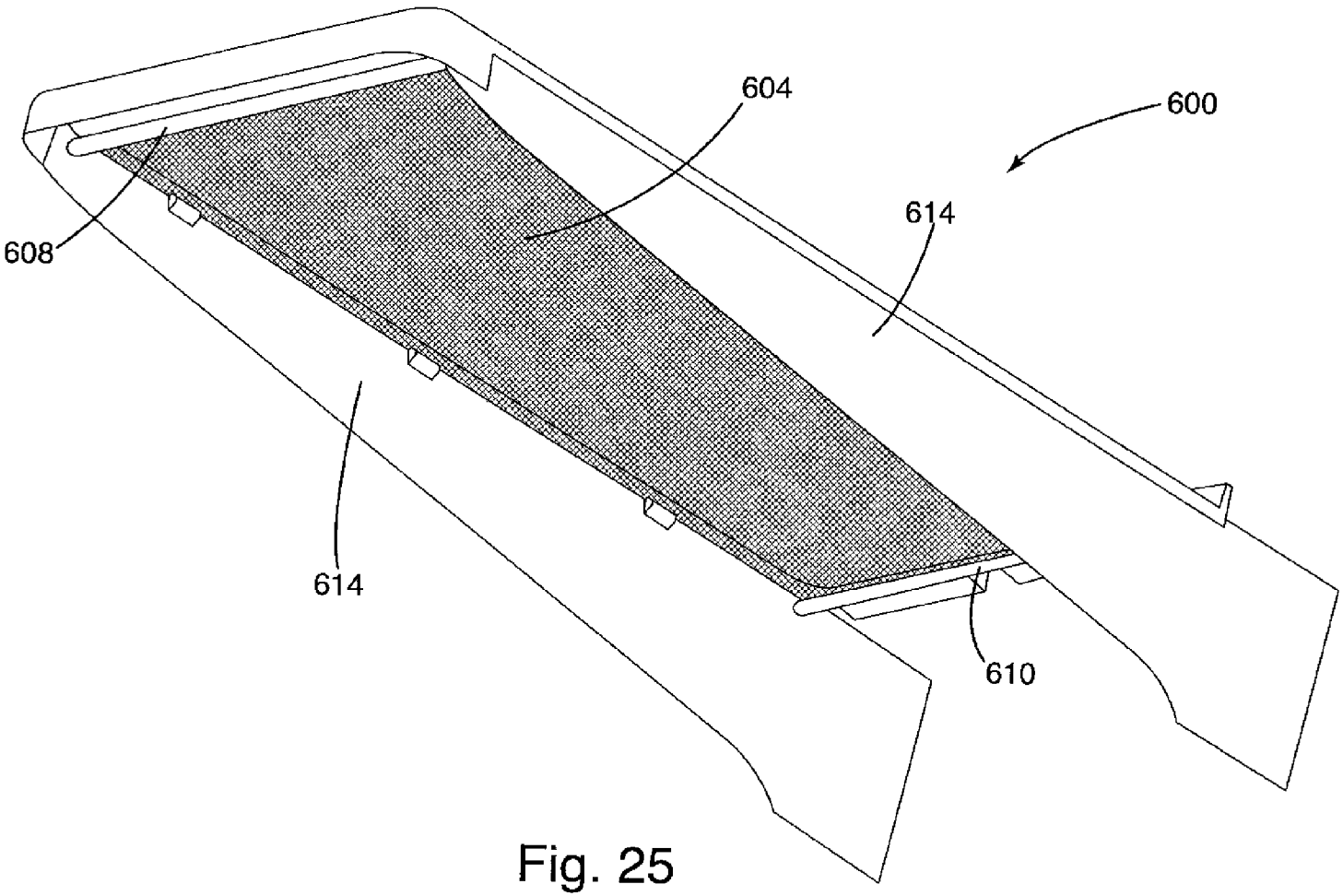
FIG. 25 is an underside, perspective view of the shelving assembly illustrated in FIG. 24.

As shown particularly in the underside view of the shelving assembly 600 in FIG. 25, the shelving assembly 600 (again, like other shelving assemblies previously described herein) includes a forward and substantially horizontally disposed frame member 608. In addition, another substantially horizontally disposed frame member 610 is positioned to the rear of the metal frame 602. These frame members 608, 610 are coupled to other structures of the shelving assembly 600 as described in subsequent paragraphs herein. Additional metal frame or sideplate attachment options may be utilized without departing from the spirit and scope of the novel concepts of the invention. For example, screw on sideplates, molded in sideplates, and snap on sideplates (all utilized in tandem with the plastic rim) may be utilized.

The shelving assembly 600 also includes a pair of opposing sideplates 614. In the particular embodiment illustrated in FIGS. 20-25, the sideplates 614 are shown as flat sideplates which depend vertically downward from the shelving assembly 600. With the particular shelving assembly 600 having stationary shelf characteristics, the sideplates 614 may also be formed as inwardly or outwardly projecting sideplates.

Figure 21:
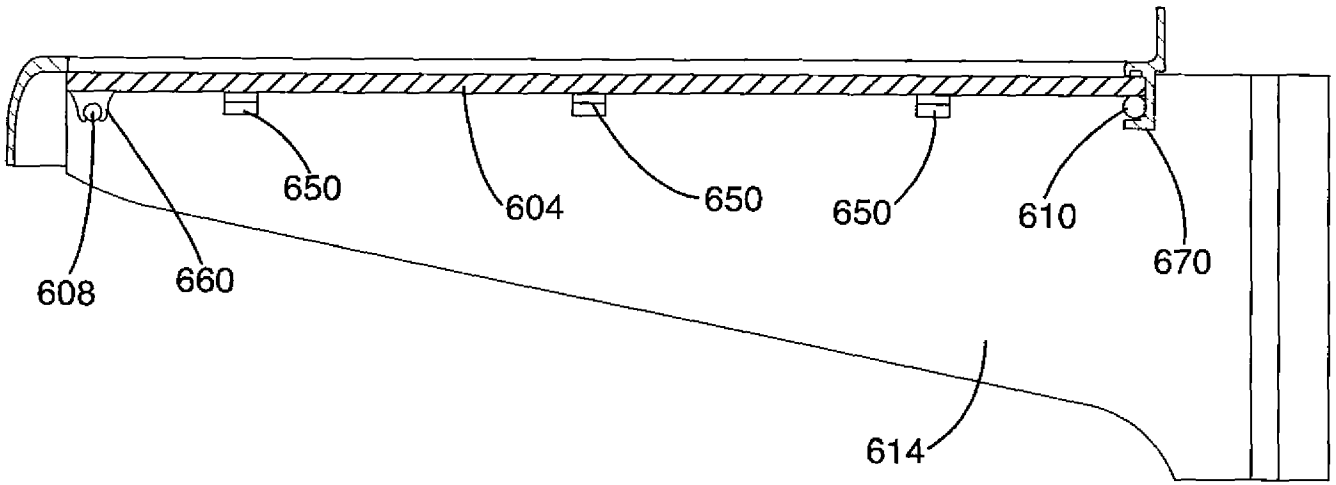
FIG. 21 is a sectional side, elevation view of the shelving assembly illustrated in FIG. 20, and showing the use of snaps (such as the snaps illustrated in FIG. 10 at various locations)

With reference specifically to FIG. 21, the shelving assembly 600 can utilize a series of snaps 650 on the sides of the shelving assembly 600. The snaps 650 can correspond in function and structure to the snaps 250 previously described with respect to FIG. 10.

Figure 22:
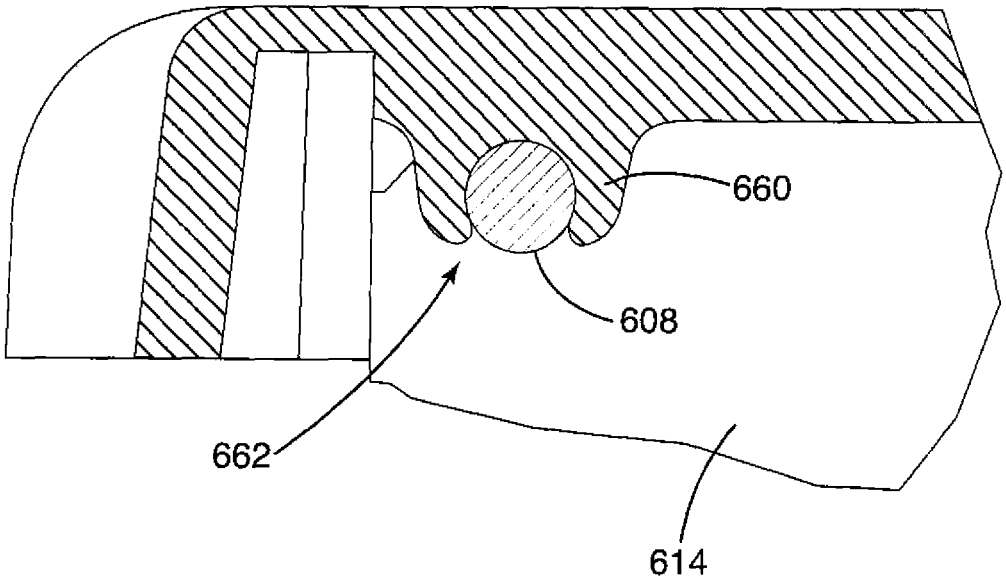
FIG. 22 is a partial sectional view, similar in structure to the left-side portion of the sectional view of FIG. 6, and illustrating the location of a front rail utilized with the shelving assembly of FIG. 20, and providing characteristics to maintain the glass shelf panel in a stationary position.

With reference to FIG. 22, the shelving assembly 600 may include a plastic engagement mechanism 660. The plastic engagement mechanism 660 is of a cross-sectional configuration as illustrated in FIG. 22. The plastic engagement mechanism 660 extends across the front portion of the shelving assembly 600. The plastic engagement mechanism 660 is of a resiliency and includes a fitted slot 662 which is used to "capture" the front frame member 608 in a "snap fit" configuration. With the forward frame member 608 coupled to remaining portions of the metal frame 602 in a manner previously described with respect to other shelving assemblies, the capture of the frame member 608 by the plastic engagement mechanism 660 maintains the glass shelf panel 604 stationary relative to the frame member 608.

Figure 23:
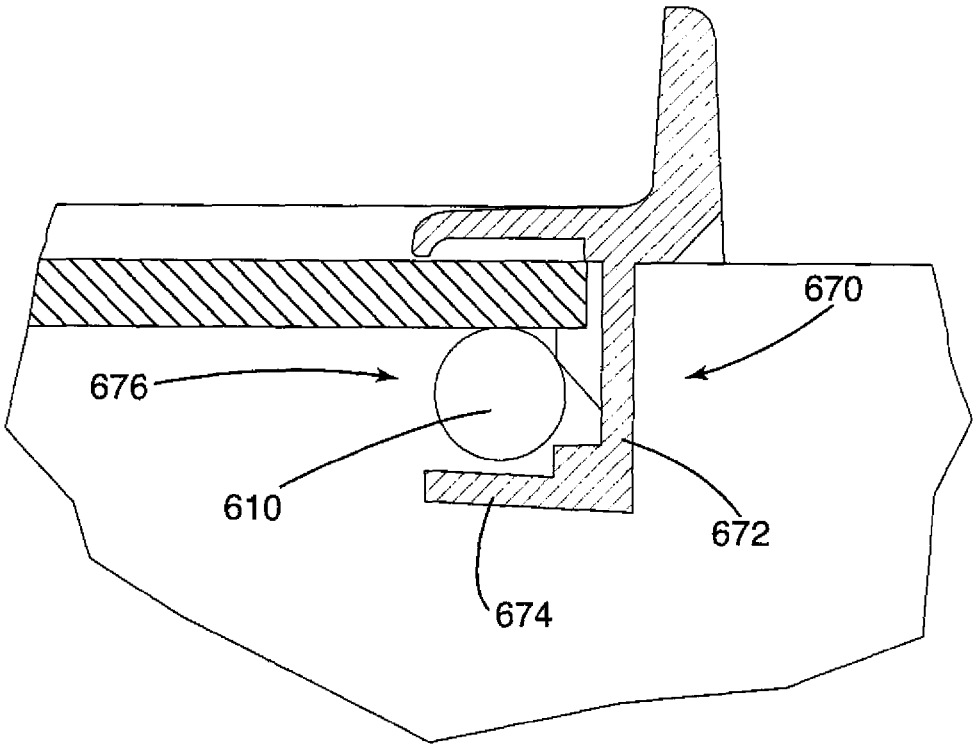
FIG. 23 is a partial sectional view, similar in structure to the right-side of the sectional view of FIG. 6, and illustrating the use of a rear plastic rail acting to hold the back of the shelf to the cantilever or metal frame at the rear frame member.
Figure 24:
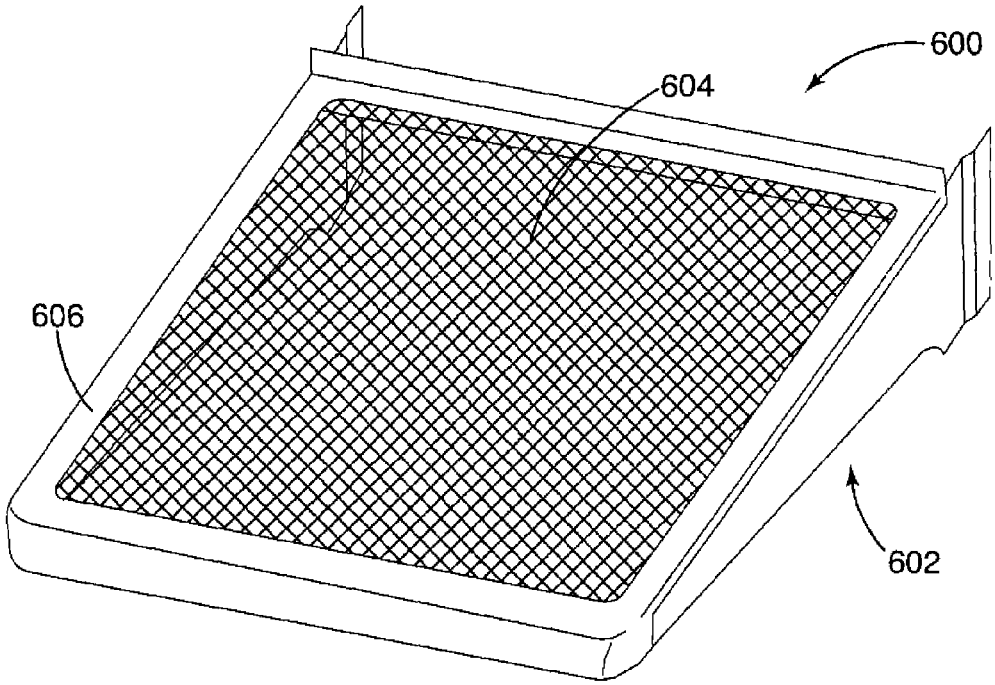
FIG. 24 is a perspective view of the shelving assembly first illustrated in FIG. 20.

Further, and with reference to FIG. 23, the rear portion of the glass shelf panel 604 is supported through the use of a rear plastic rail 670 having a cross-sectional configuration as shown in FIG. 23. The rear plastic rail 670 includes a downwardly projecting section 672. Positioned at the terminating end of the downwardly projecting section 672 and integral therewith is a horizontally disposed section 674 which is substantially perpendicular to the section 672. The downwardly projecting member 672 and the horizontally disposed member 674 form a slot 676 as illustrated in FIG. 23.

Figure 26:
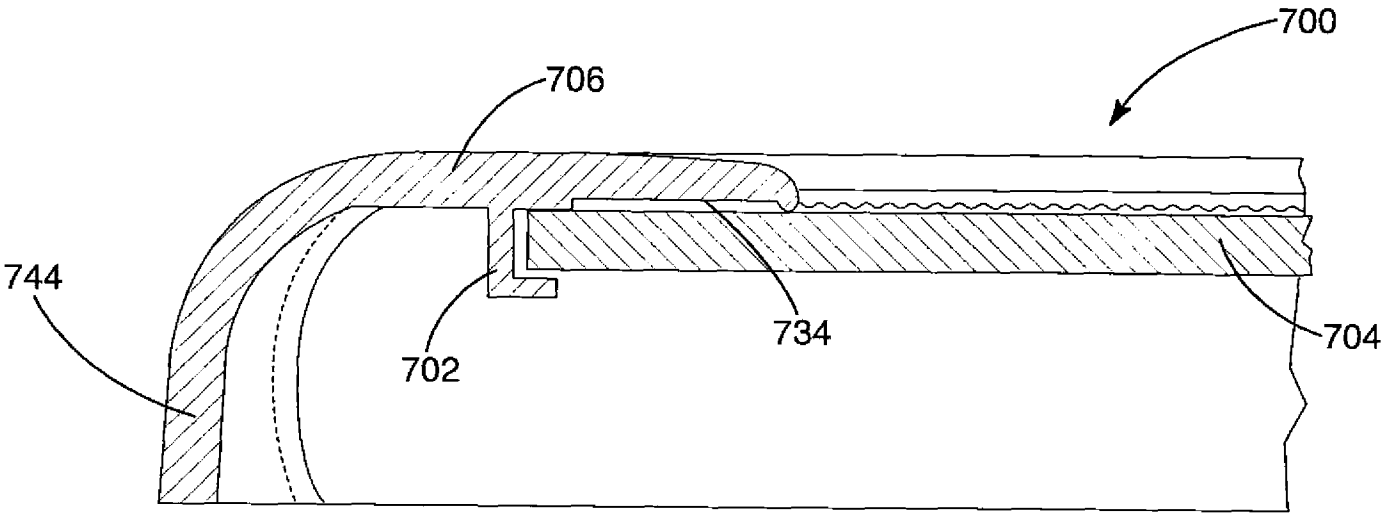
FIG. 26 is a partial sectional view, similar in content to the left-side portion of the sectional view of FIG. 6, and illustrating an alternate embodiment employing a support ledge as part of the plastic rim, for purposes of facilitating retention of the glass shelf, and for aiding in the assembly of the glass shelf panel, plastic rim and adhesive.

An alternative embodiment of a shelving assembly is illustrated in FIG. 26. Referring specifically to FIG. 26, the drawing of FIG. 26 illustrates, in part, a cross-section of the front or forward area of the plastic rim 706. This configuration is similar to the left-side portion of the drawing of FIG. 6. As with FIG. 6, the shelving assembly configuration 700 includes the plastic rim 706 with a projecting forward lip 744. The plastic rim 706 is secured to the glass shelf panel 704 through use of the adhesive 734. However, unlike the embodiment illustrated in FIG. 6, the shelving assembly 700 includes a support ledge 702 illustrated in cross section in FIG. 26. The support ledge 702 preferably extends along the entire periphery of the forward portion of the shelving assembly 700. Also, the shelving assembly 700 preferably includes (although not shown specifically in FIG. 26) the use of snaps on the remaining three sides of the shelf assembly 700. Such snaps can correspond in function and structure to the snaps 250 previously described with respect to FIG. 10. The primary purpose of the support ledge 702 is to facilitate retention of the glass shelf panel 704 within the entire shelving assembly. In addition, the support ledge 702 assists in stabilizing the glass shelf panel 704 during the process of assembly of the shelf panel 704, plastic rim 706 and the adhesive 734. As an alternative to use of the support ledge 702 in the forward portion of the shelving assembly 700, the support ledge 702 could alternatively be positioned at the rear portion of the shelving assembly 700.

Figure 27:
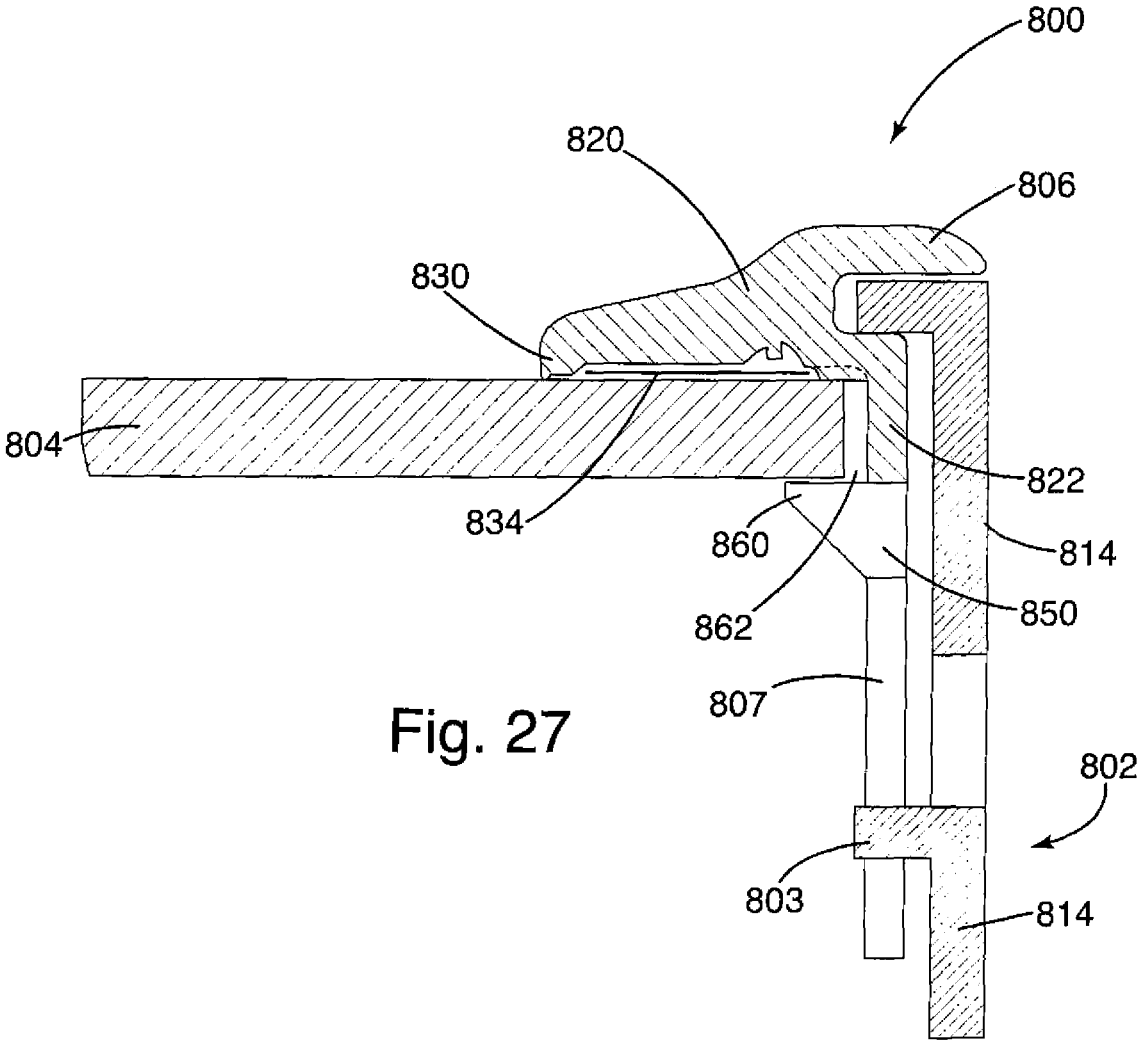
FIG. 27 is a sectional view similar in perspective and content to the views of FIGS. 7, 10, 11, and 12 and illustrating the use and relative positioning of a plastic stop which may be employed and utilized with the snaps, such as the snaps illustrated in FIG. 10.

An alternative embodiment to those previously described herein is the shelving assembly 800 illustrated in FIG. 27. The shelving assembly 800 is somewhat similar in scope to the shelving assembly 400 previously described herein with respect to FIG. 12. More specifically, the shelving assembly 800 includes a glass shelf panel 804, plastic rim 806 and metal frame with sideplates 814. In addition, an adhesive 834 is utilized to secure the glass shelf panel 804 to the plastic rim 806. Similar to FIG. 12, the shelving assembly 800 may also include a series of snaps 850. That is, and in a manner similar to FIG. 12, a horizontally disposed lower ledge 860 depends from the downwardly projecting member 822 of the plastic rim 806. The foregoing elements are substantially included within the shelving assembly 400 as illustrated in FIG. 12 and described in prior paragraphs hereof. However, distinguishable from shelving assembly 400, the shelving assembly 800 includes a plastic stop 807 depending downwardly from the lower and horizontally disposed ledge 860. The plastic stop 807 is associated with one of the snaps 850 positioned on one side of the shelving assembly 800, and one of the snaps 850 positioned on the opposing side of shelving assembly 800.

In addition to the plastic stops 807, the shelving assembly 800 also includes a horizontally and inwardly depending metal protrusion 803 which is preferably integral with the metal sideplate 814 and extending therefrom. The relative positioning of the metal protrusion 803 is as shown in FIG. 27. With the metal protrusion 803 and the plastic stop 807, the combination thereof provides for a stop mechanism for the feature of the shelving assembly 800 comprising slidable properties. That is, as the glass panel 804 and plastic rim 806 are slid forwardly on the metal cantilever frame 802, the provision of the plastic stop 807 on each side of the shelving assembly 800 abutting a metal protrusion 803 extending from the sideplate 814 (again on each side of the shelving assembly 800), prevents the plastic rim 806 and the glass shelf panel 804 from sliding off of the metal cantilever frame 802. Again, the plastic stops 807 are only associated with the snaps 850 which include the horizontally depending ledge 860. Still further, these plastic stops are only associated with two of the snaps located on opposing sides of the shelving assembly 800.

It should be emphasized that various configurations of the concept of providing "stop" features as illustrated in FIG. 27 for shelving assembly 800 may be utilized. For example, the metal protrusion 803 maybe punched out, formed, or fastened so as to be horizontally depending or vertically depending, as is desired with respect to the sideplate 814. As shown in FIG. 27, the metal protrusion 803 is horizontally depending. However, the metal protrusion 803 could, alternatively, be vertically depending, and bent in a manner so that the metal protrusion 803 was primarily in a vertical configuration. With the metal protrusion 803 in a vertical configuration, it can provide a greater cross sectional area for abutment against the plastic stop 803. In this matter, the "stop" feature may be somewhat enhanced.

Figure 28:
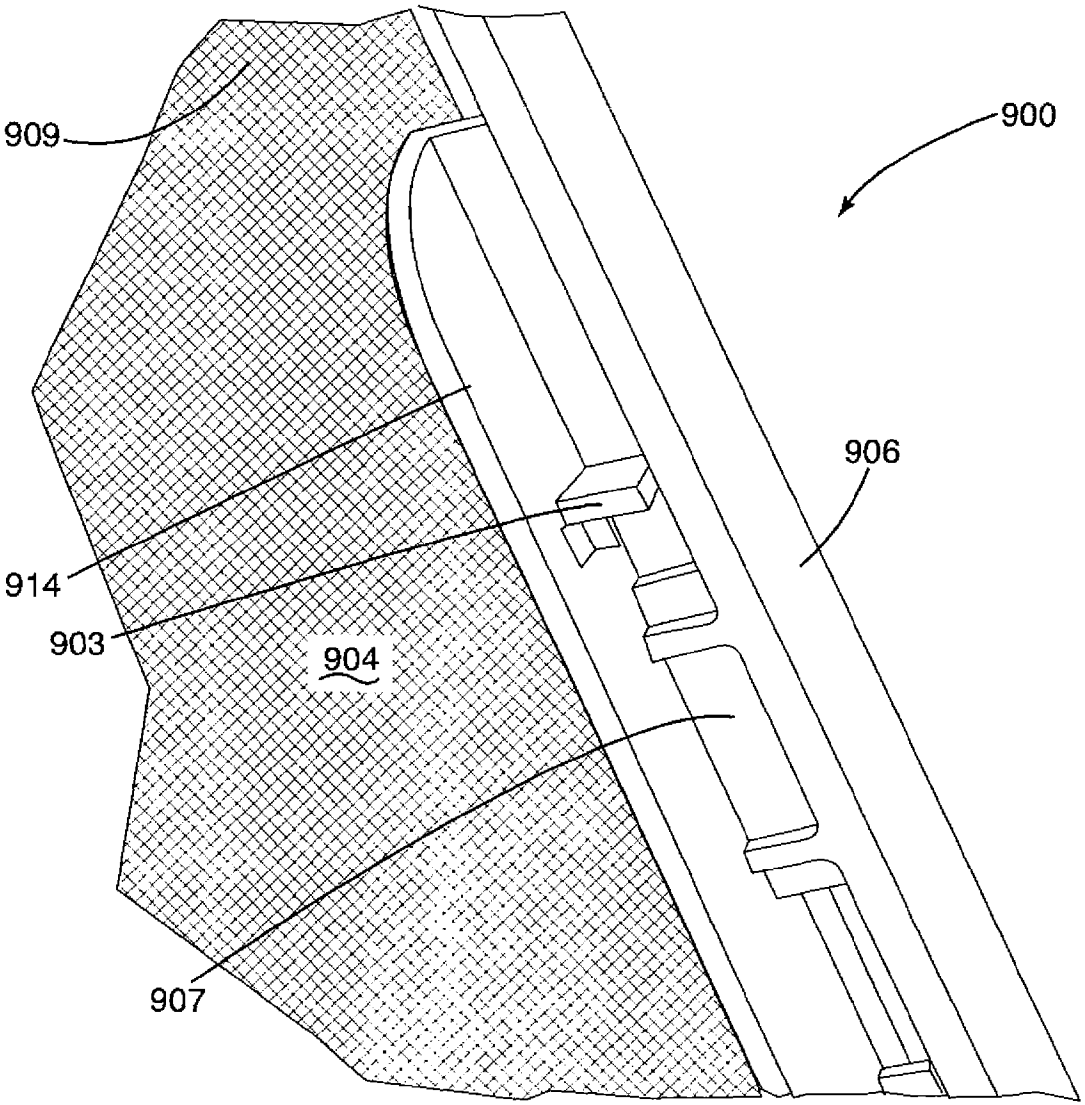
FIG. 28 is an underside view of the metal protrusion and plastic stop that combine to provide a stop mechanism for the plastic rim and glass shelf panel assembly relative to a metal frame with sideplates.

Another embodiment of a stop mechanism is illustrated in shelving assembly 900 as seen in FIG. 28. Shelving assembly 900 is similar in scope to shelving assembly 100 previously described in FIGS. 1-9. A plastic rim 906 is bonded to a glass shelf panel 904 through the use of an adhesive. A metal frame with outwardly depending sideplates 914 is utilized. However, inwardly depending sideplates and flat sideplates may also be utilized. Similar to shelving assembly 800 in FIG. 27, shelving assembly 900 as seen in FIG. 28 may utilize a sideplate 914 with a metal protrusion 903 that acts in combination with a plastic stop 907 that is integral with the plastic rim 906. The metal protrusion 903 and plastic stop 907 in shelving assembly 900 perform a similar function as the metal protrusion 803 and plastic stop 807 as described in FIG. 27. This stop mechanism can be utilized with the sliding shelving assemblies previously described herein. Also, as illustrated in FIG. 28, the glass shelf panel 904 may contain decoration 909 by means including but not limited to frosting, etching, or as is desired to conceal viewing of the adhesive on the underside of the shelving assembly 900.

Figure 29:
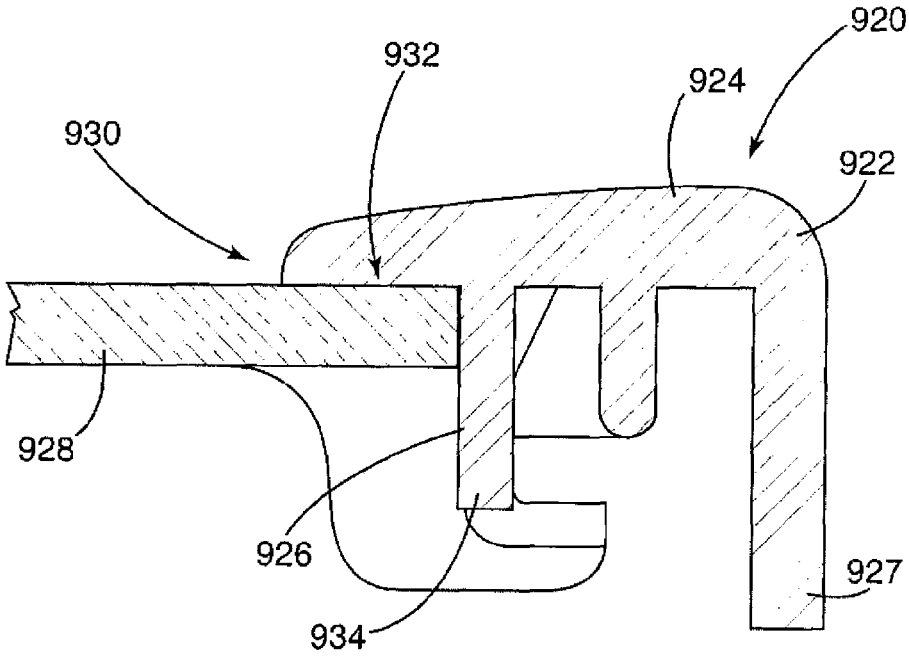
FIG. 29 is a sectional view similar in perspective and content to the views of FIGS. 7, 10, 11, 12, and 27, and illustrating the use and relative positioning of a heat stake rib which may be utilized with the shelving assembly.
Figure 30:
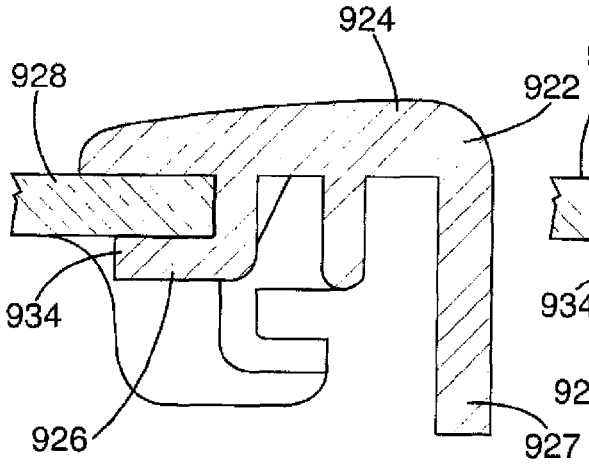
FIG. 30 is a sectional view similar to FIG. 29, but showing the heat stake rib curved so that a lower section thereof is flexed inwardly toward and below the glass shelf panel, with the heat stake rib being hot formed with a small radius tool.
Figure 31:
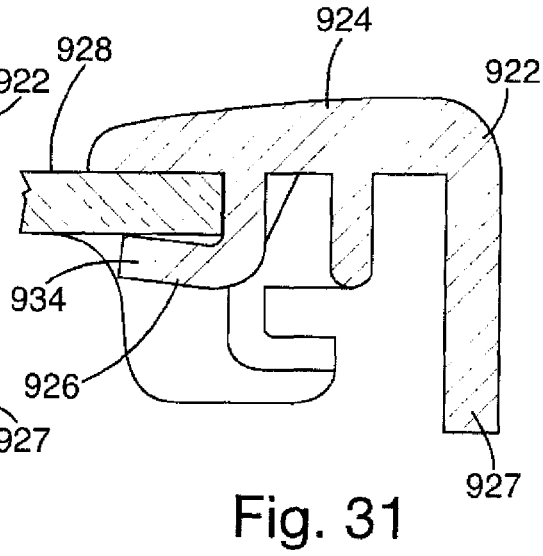
FIG. 31 is a sectional view similar to FIG. 30, but showing the securing position of the heat stake rib after being hot formed with a large radius tool.

A still further embodiment of a shelving assembly is illustrated in part as shelving assembly 920 illustrated in FIGS. 29, 30 and 31. For purposes of clarity and brevity, the entirety of the shelf assembly 920 is not illustrated. In substantial part, the shelf assembly 920 is similar in design and construction to shelf assembly 200, 400 and 800 illustrated in FIGS. 10, 12 and 27, respectively. The distinctions of shelf assembly 920 relative to the other shelf assemblies resides in the use of heat stake principles for purposes of providing additional securing of the plastic rim to the glass shelf panel. More specifically, and with reference to FIGS. 29, 30 and 31, the shelving assembly 920 includes a plastic rim 922, somewhat similar in structure and function to the plastic rims 106, 206, et al. previously described herein. The plastic rim 922 includes a horizontally disposed section 924 and a downwardly projecting section 926, extending downwardly, and integral with the horizontally disposed section 924 is a downwardly projecting section in the form of a heat stake rib 926. The heat stake rib 926 is adjacent the perimeter of the glass shelf panel 928. If desired, the shelving assembly 920 may also include a spatial area 930 formed between the plastic rim 922 and the glass shelf panel 928. Within the spatial area 930, an adhesive 932 may be provided so as to secure and couple together the glass shelf panel 928 and the plastic rim 922.

A plurality of heat stake ribs 926 may be positioned at various locations on the front, back and sides (or combinations thereof) of the plastic rim 922. The entirety of a heat stake rib 926 is illustrated in partial perspective view in FIGS. 34 and 35. With reference to the shelving assembly 200 illustrated in FIG. 10, the heat stake ribs 926 replace the series of snaps 250 associated with the shelving assembly 200.

For purposes of assembly, the series of heat stake ribs 926 may be heated by appropriate means. When one of each of the heat stake ribs 926 is heated to an appropriate temperature, the ribs 926 become pliable and thus flexible. While in this heated state, each of the heat stake ribs 926 may be bent or curved so that a lower section 934 of each heat stake rib may be flexed inwardly toward and below the glass shelf panel 928. The process of heating the ribs 926 is conventionally referred to as "hot forming," and is a practice which is known in the industrial arts. When the heat stake ribs 926 are appropriately formed toward and below the glass shelf panel 928, the ribs 926 take the form as illustrated in FIGS. 30 and 31. More specifically, FIG. 30 illustrates the positioning of the heat stake rib 926 after being hot formed with a small radius tool. Correspondingly, FIG. 31 illustrates the securing position of the heat stake rib 926 toward and below the glass shelf panel 928 after being hot formed with a large radius heat stake tool. In each case, the heat stake ribs 926 are formed over and onto the glass shelf panel 928. In this manner, the heat stake ribs 926 provide additional support for the glass shelf panel 928. In addition, the formation of the heat stake ribs 926 is such that the ribs 926 may be more readily formed with a greater length than the tabs of the snaps 250 previously described with respect to the shelving assembly 200. This additional length increases the supporting strength of the heat stake ribs 926 relative to the snaps 250.

Figure 32:
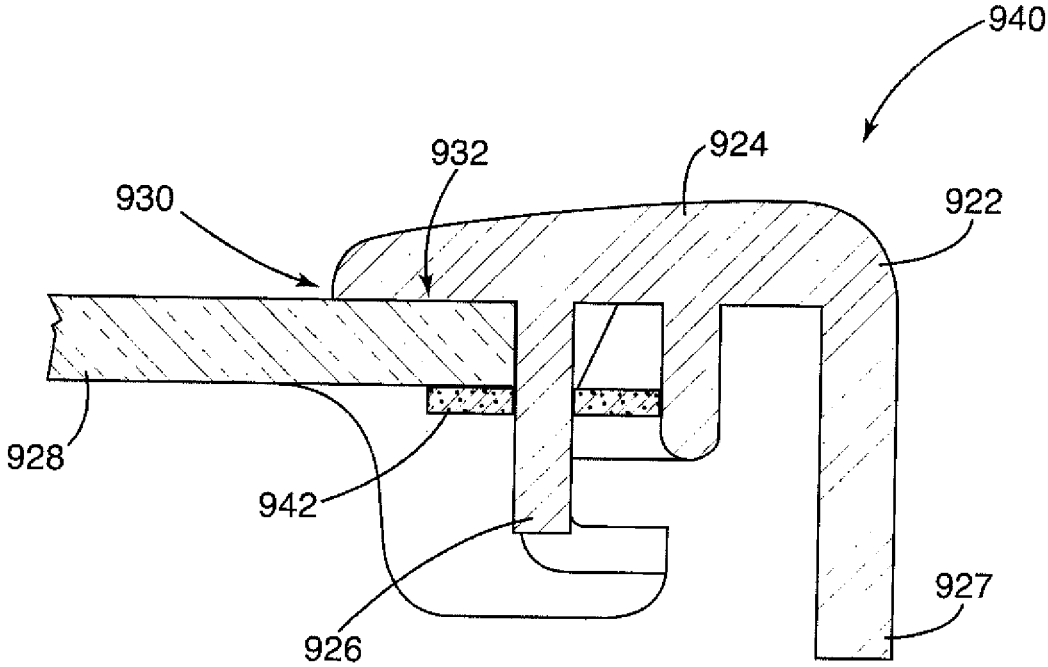
FIG. 32 is a sectional view similar to FIG. 29, but showing the use of a heat stake pad with the heat stake rib.
Figure 33:
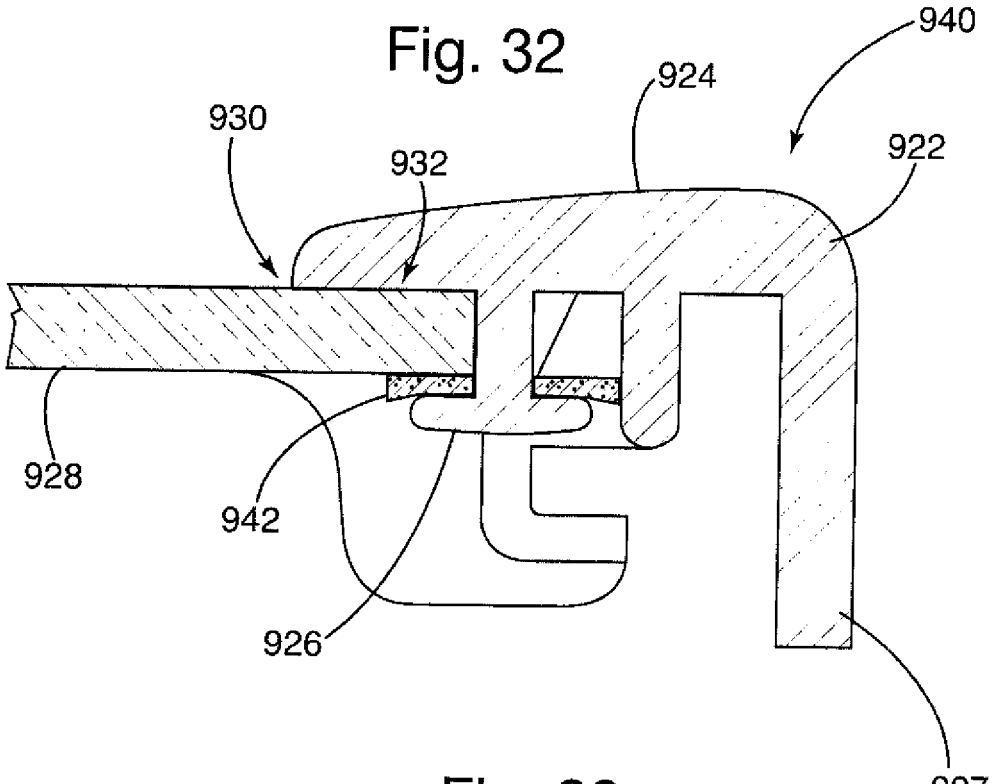
FIG. 33 is a sectional view of the heat stake pad and the heat stake rib of FIG. 32, but showing the heat stake rib after being heated and causing the heat stake pad to abut the lower portion of the glass shelf panel.
Figure 34:
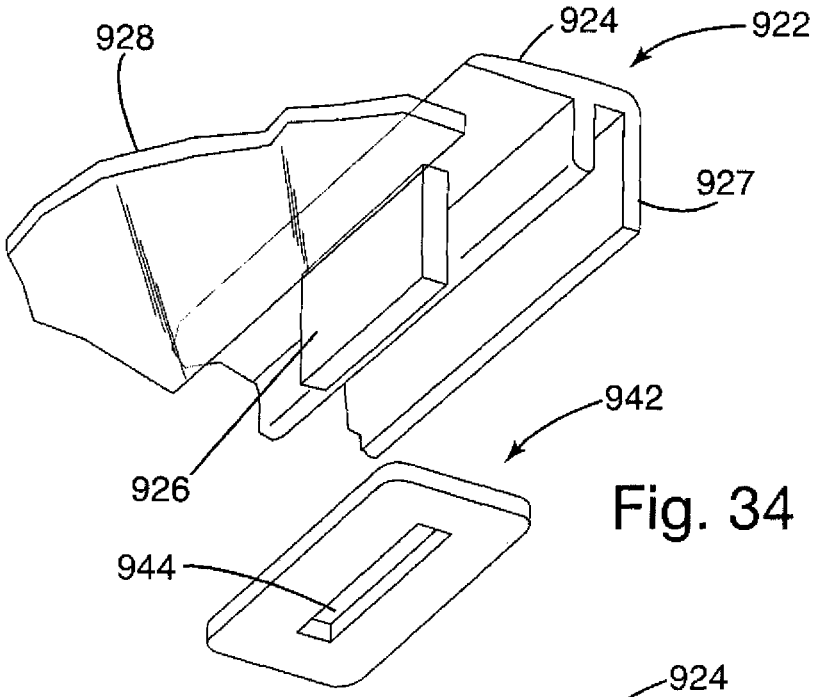
FIG. 34 is a perspective, underside view illustrating the relationship between a heat stake rib and a heat stake pad.
Figure 35:
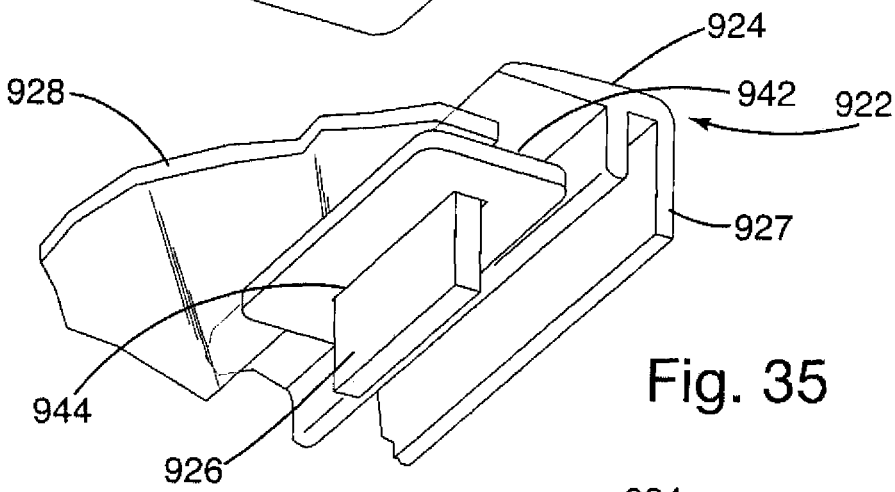
FIG. 35 is a perspective, underside view similar to FIG. 34, but showing a configuration where the heat stake rib is received within the aperture of the heat stake pad.
Figure 36:
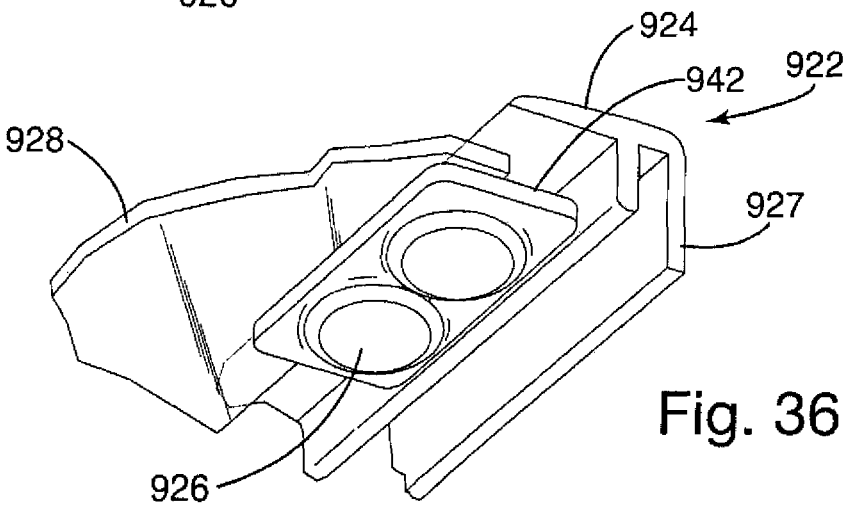
FIG. 36 is similar to FIG. 35, but shows a "final" configuration of the heat stake rib and heat stake pad after heating, with the heat stake pad abutting a lower portion of the shelf panel.

FIGS. 32-36 illustrate the use of the heat stake ribs 926, but with a particular means for hot forming the ribs 926 and a securing configuration distinguishable from the "bending over" of the ribs 926 relative to the glass shelf panel 928. More specifically, the shelving assembly illustrated in FIGS. 32-36 (identified as shelving assembly 940) is substantially similar to shelving assembly 920, but includes the use of additional elements identified as heat stake pads 942. A heat stake pad 942 or series of heat stake pads will be associated with each of the heat stake ribs 926 or series of heat stake ribs. The structural configuration of a heat stake pad 942 is best illustrated in FIG. 34. Specifically, each heat stake pad 942 may have a substantially rectangular configuration, with a relatively small thickness. The heat stake pads 942 may be constructed of various types of materials. For example, each heat stake pad 942 may be constructed of ABS plastic. As further illustrated in FIG. 34, each heat stake pad 942 includes a substantially rectangular aperture 944. Each aperture 944 is appropriately sized so as to fit the cross sectional configuration of a corresponding heat stake rib 926. For purposes of assembly, the heat stake pads 942 are appropriately positioned below the heat stake ribs 926 and then moved upwardly so that the corresponding heat stake rib 926 is received within the aperture 944 of the heat stake pad 942. This configuration is best illustrated in FIGS. 32 and 35. Each heat stake rib 926 or series of heat stake ribs may be appropriately heated by a heat stake tool (not shown). The heat stake tool may use various forms of heat. For example, the heat stake tool may use infra-red heat. The heat of the heat stake tool will cause each of the corresponding heat stake ribs 926 to increase in temperature. This increase in temperature will cause the heat stake ribs to become pliable. When the heat stake ribs 926 have reached an appropriate temperature, pressure can be exerted on the bottom portion of each heat stake rib 926 so as to cause the portion of each heat stake rib 926 located below the aperture 944 of a corresponding pad 942 to become deformed and "tightened" against the lower portion of the corresponding heat stake pad 942. This configuration is best illustrated in FIGS. 33 and 36. With this configuration, and as specifically illustrated in FIG. 33, the heat stake pad 942 abuts the lower portion of the glass shelf panel 928. When each of the heat stake pads 942 and ribs 926 cool back to an ambient temperature, the deformation of the lower portion of each heat stake rib 926 provides lower support of a corresponding one of the pads 942 in a manner so as to again provide additional support for the glass shelf panel 928.

Figure 37:
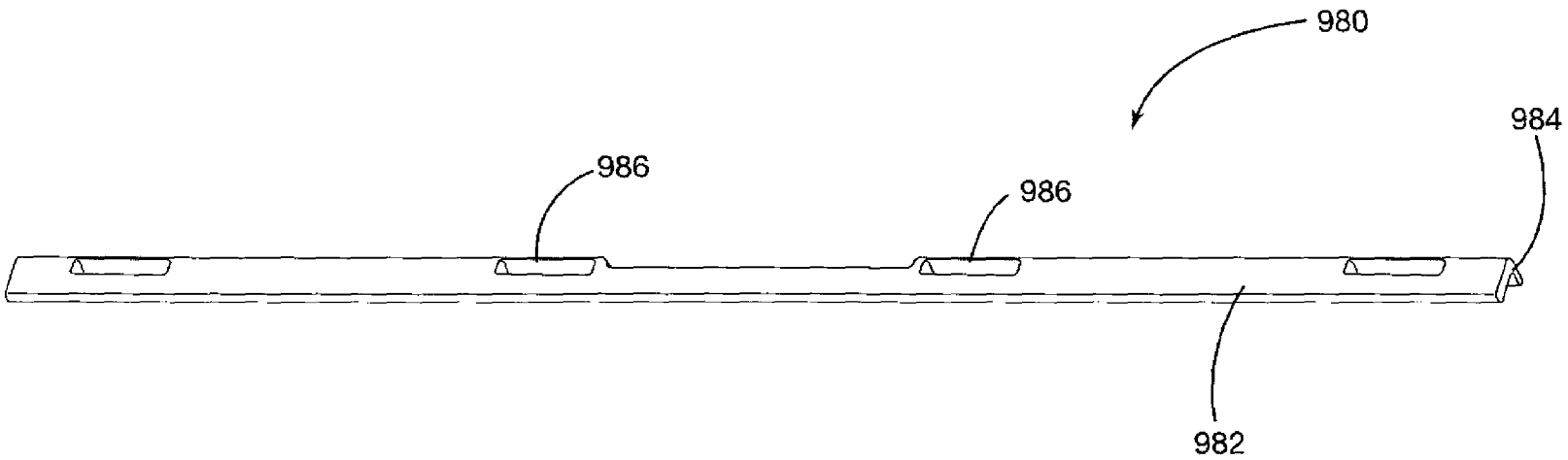
FIG. 37 is a partially perspective view of an elongated and alternative configuration of a heat stake pad, with the heat stake pad having an L-shaped configuration and a series of four apertures for receiving four corresponding heat stake ribs.

As an example of an alternative configuration for the heat stake pads, a heat stake pad 980 is illustrated in FIG. 37. The heat stake pad 980 is of an L-shaped configuration. More specifically, the heat stake pad 980 includes an elongated member 982. Positioned longitudinally along the elongated member 982 are a series of apertures 986. The apertures 986 have the same function as the aperture 944 previously described with respect to the heat stake pads 926 illustrated in FIGS. 34, 35 and 36. That is, the apertures 986 are adapted to receive the heat stake ribs 926. Still further, the heat stake pad 980 includes a leg member 984 which may be integral with the member 982 but extends perpendicularly thereto. When the heat stake pad 980 is appropriately positioned with heat stake ribs 926 appropriately received within the corresponding apertures 986, the elongated member 982 will abut the lower portion of a corresponding shelf panel as previously described with the heat stake pads 942.

Figure 38:
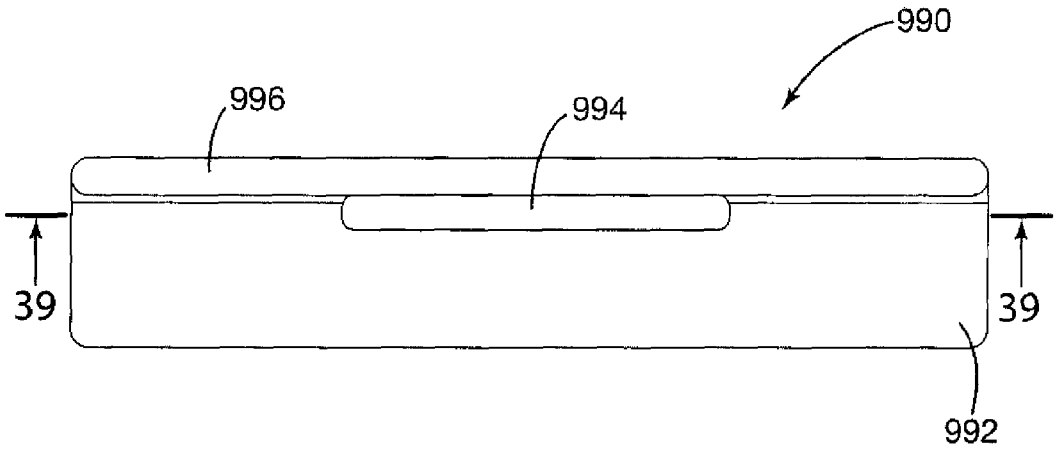
FIG. 38 is a plan view of a heat stake pad having an L-shaped configuration, and having a single aperture for receiving a single heat stake rib.
Figure 39:
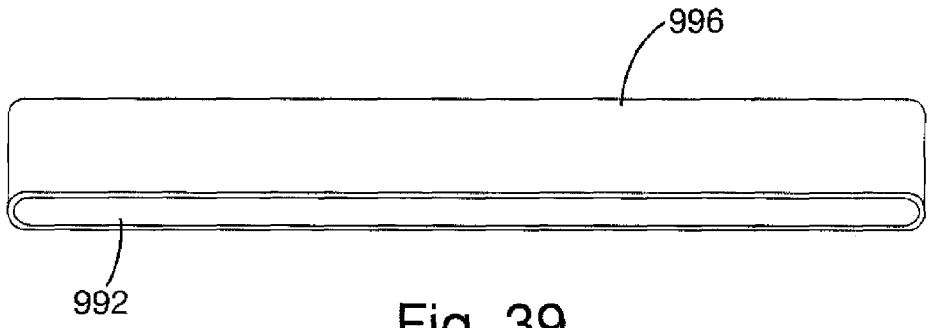
FIG. 39 is a section view of the heat stake pad illustrated in FIG. 38, taken along section lines 39-39 of FIG. 38.
Figure 40:
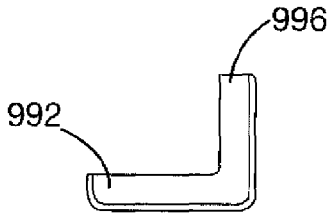
FIG. 40 is an end view of the heat stake pad illustrated in FIGS. 38 and 39.

A further embodiment of a heat stake pad is illustrated in FIGS. 38, 39 and 40 as heat stake pad 990. The heat stake pad 990 is similar in construction to the heat stake pad 980, in that the heat stake pad 990 is of an L-shaped configuration. That is, the heat stake pad 990 includes a member 992 integral with or otherwise connected to a perpendicular leg member 996. However, unlike the heat stake pad 980 which includes a series of apertures 986 for receiving a series of heat stake ribs 926, the heat stake pad 990 includes only a single aperture 994. Correspondingly, the heat stake pad 990 is therefore adapted to receive only a single heat stake rib 926 through the aperture 994. When appropriately positioned relative to a shelf panel, and appropriately heated, the heat stake pad 990 will have its member 992 abutting the lower portion of the corresponding shelf panel.

Figure 41:
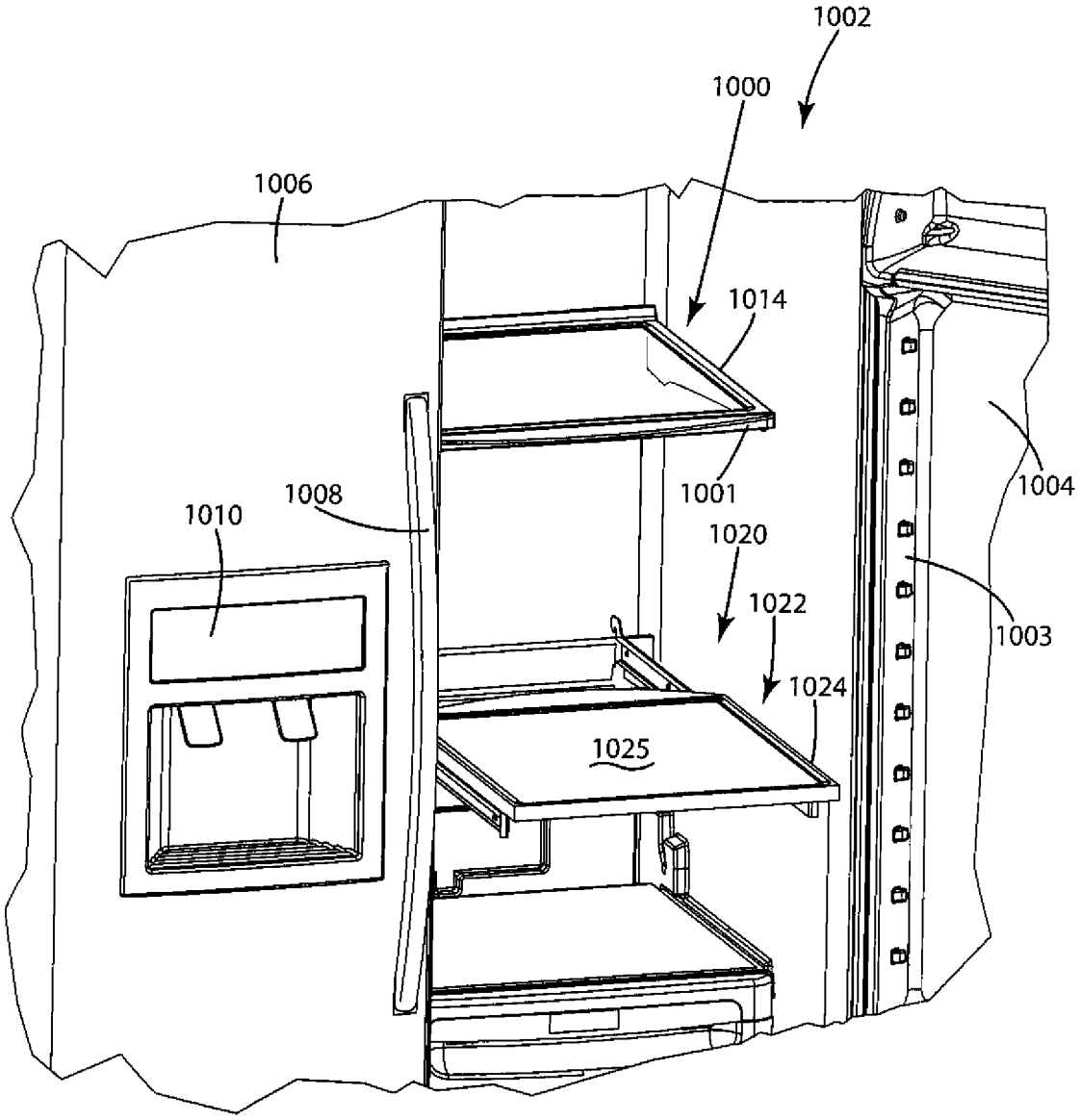
FIG. 41 is a general partially perspective and elevation view showing a current shelf design and how the shelf design interferes with a portion of the refrigerator door, and further shows a shelf design, where the shelf design clears the refrigerator door through the use of an offset on the right side of the shelf.

With respect to the current invention, and as earlier stated, the principles of the invention are disclosed with respect to a shelf assembly 1020 as primarily illustrated in FIGS. 41-52. With reference first to FIG. 41, the drawing illustrates a refrigerator 1002 having a prior art shelf 1000. The refrigerator 1002 includes a right side refrigerator door 1004 and left side refrigerator door 1006. The refrigerator 1002 can be conventional in design and the left side refrigerator door 1006 also includes a handle 1008. The right side refrigerator door 1004 is shown in an open configuration. As further shown in FIG. 41 to represent the prior art, the prior art shelf 1000 can be characterized as a slidable shelf assembly. However, as shown in FIG. 41, a front portion 1001 of the prior art shelf 1000 will abut a bracket 1003 associated with the right side refrigerator door 1004 when an attempt is made to extend the prior art shelf 1000.

To overcome this problem, and to provide certain other advantageous features in accordance with the invention, the shelf assembly 1020 as further shown in FIG. 41 may be utilized in accordance with the invention. With reference primarily first to FIGS. 41-44, the shelf assembly 1020 may be in the form of an extendable refrigerator shelf which can be extended between a retracted position (fully retracted toward the rear of the refrigerator) and a fully extended position, so as to facilitate placement and removal of articles on the shelf by the user. The refrigerator shelf 1022 also includes a shelf frame 1024. The shelf frame 1024 can be characterized as being part of the refrigerator shelf 1022, and provides a supporting and attachment frame for a shelf surface panel 1026. The shelf surface panel 1026 may be made of a number of different types of materials, and may include a glass shelf or shelf panel. Further, the shelf frame 1024 may be in the form of a plastic rim or other type of supporting material.

Figure 42:
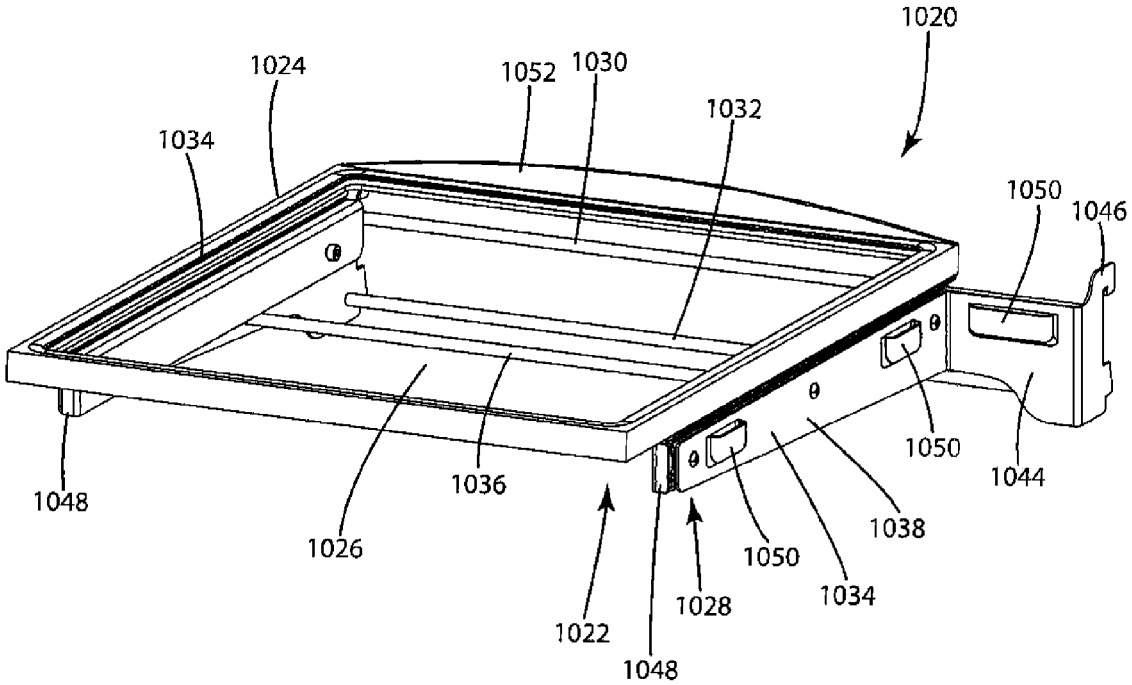
FIG. 42 is a perspective view of a refrigerator shelf, with the shelf being shown in a retracted position.
Figure 43:
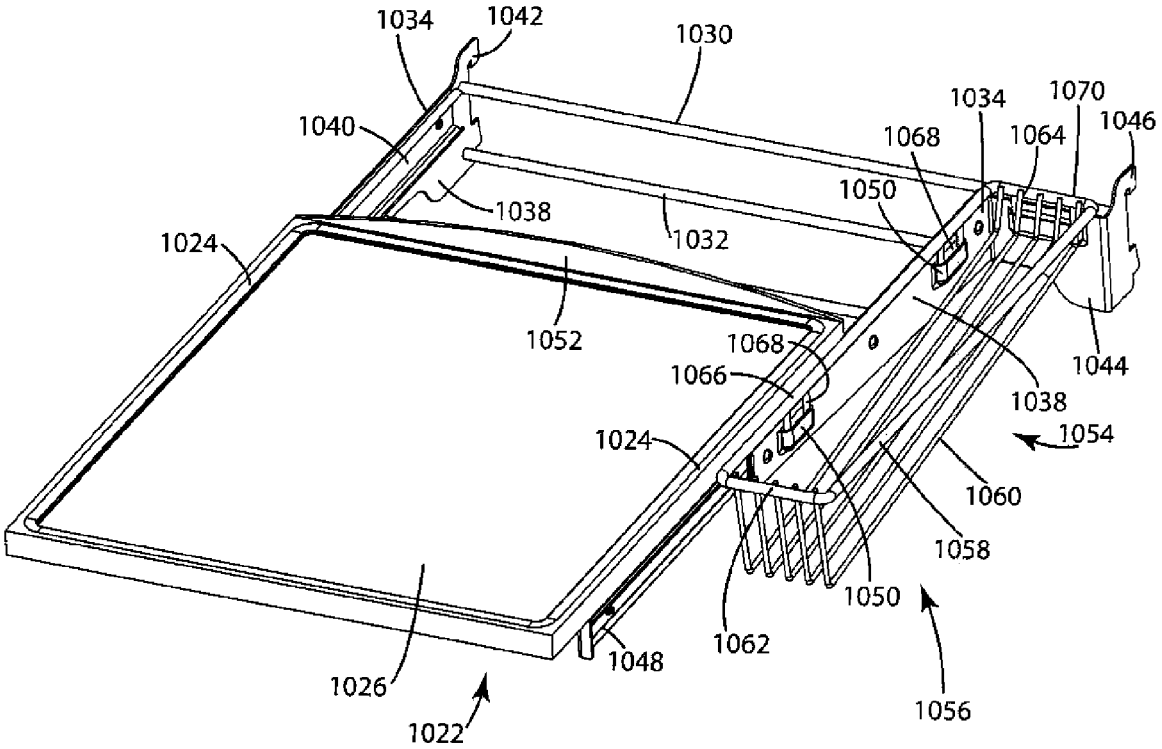
FIG. 43 is a perspective view of the refrigerator shelf shown in FIG. 42, and showing the shelf in a partially extended position.
Figure 44:
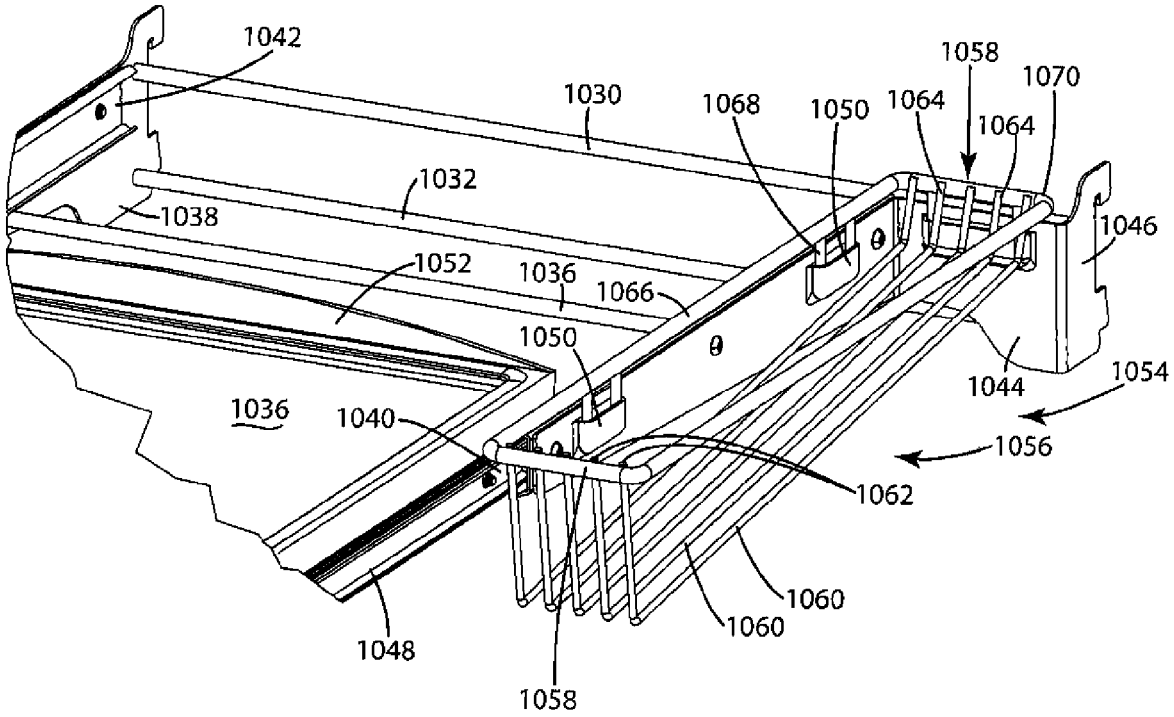
FIG. 44 is a partial view of the refrigerator shelf shown in FIG. 42, and showing the relative positioning and connection of a storage rack to the shelf.

In addition to the refrigerator shelf 1022, the shelf assembly 1020 includes a cantilever frame 1028. With reference primarily to FIGS. 42, 43 and 44, the cantilever frame 1028 remains stationary within the refrigerator 1002 and is utilized to slidably support the refrigerator shelf 1022. The cantilever frame 1028 includes horizontally disposed frame members comprising an upper rear frame member 1030, lower rear frame member 1032 and middle supporting frame member 1036. Also, although not shown in the drawings, additional horizontally disposed frame members may be utilized. The frame members 1030, 1032 and 1036 may be coupled by any suitable means (not shown) to a pair of opposing and parallel sideplates 1034. The sideplates 1034 may include downwardly projecting side members 1038. Appropriately connected by any suitable means (not shown) to the inside of each of the side members 1038 is a slide track 1040. The slide tracks 1040 remain stationary during movement of the refrigerator shelf 1022. The slide tracks 1040 are utilized in combination with bearing slides 1048 which are appropriately mounted downwardly from opposing sides of the shelf frame 1024. The bearing slides 1048 can include ball bearings or the like and can be slidably received within the slide tracks 1040. This type of slidable engagement utilizing ball bearings or similar means is well known in the industry. With the use of the bearing slides 1048 and the slide tracks 1040, manually exerted forces on the refrigerator shelf 1022 can cause the shelf to slidably move forwardly or rearwardly relative to the shelf frame 1024. Although not specifically shown, the shelf assembly 1020 can include stops or similar means for purposes of limiting forward movement of the refrigerator shelf 1022 relative to the cantilever frame 1028. Of primarily importance, it should be noted that assuming there are no obstacles to movement, the refrigerator shelf 1022 of the shelf assembly 1020 is designed to move from a retracted position (such as shown in FIG. 42) to a fully extended position relative to the cantilever frame 1028.

In addition to the foregoing elements, the shelf assembly 1020 also includes a left side hanger set 1042 which extends rearwardly from (and may be integral with) the left sideplate 1034. The left side hanger set 1042 may be utilized as cantilever brackets of relatively conventional design, so as to removably lock the cantilever frame 1028 into tracks (not shown) connected to walls of the refrigerator 1002.

With further reference primarily to FIGS. 42, 43 and 44, and in accordance with the invention, the shelf assembly 1020 includes a right side rear bracket extension 1044. The right side rear bracket extension 1044 preferably extends directly to the right from the right ends of the upper rear frame member 1030 and lower rear frame member 1032. The extension 1044 can be integral with the frame members 1030 and 1032, or otherwise connected to the same by any suitable connecting means (not shown). With the rear bracket extension 1044 in accordance with the invention, the shelf assembly 1020 and the associated refrigerator shelf 1022 is essentially "offset" from one end of the refrigerator 1002. This offset provides the advantageous feature that when the refrigerator shelf 1022 is extended forwardly relative to the cantilever frame 1028, the front end of the refrigerator shelf 1022 will not abut or otherwise be interfered with by the inner portion of the refrigerator door when the door in an opened position.

With respect to other features associated with the shelf assembly 1020, a spill flange 1052 can be provided at the rear portion of the refrigerator shelf 1022. Further, and in accordance with another aspect of the invention, sets of inserts 1050 can be positioned on a forwardly directed surface of the rear bracket extension 1044 and on the sides of the side member 1038. The purpose and advantageous features of the inserts 1050 will be described in subsequent paragraphs herein.

In addition to the concept of providing for an offset for the shelf assembly 1020, an additional concept in accordance with certain aspects of the invention relates to the advantageous feature of providing functional space with respect to the offset. As shown, for example, in FIGS. 43 and 44, a rack 1054 may be utilized in combination with the shelf assembly 1020 for purposes of storing of various types of food and beverage articles. The rack 1054 may be of any desired configuration, and a number of different configurations are described in subsequent paragraphs herein and illustrated in the drawings. In FIGS. 43 and 44, a rack 1054 which can be characterized as a can rack 1056 is provided. The can rack 1056 comprises a rack rim 1058. In this particular case, the rack rim 1058 has a rectangular configuration and is horizontally disposed. Projecting downwardly from the rack rim 1058 is a set of support wires 1060 having a substantially parallel configuration as illustrated in FIGS. 43 and 44. The front ends 1062 of the support wires 1060 are welded or otherwise connected to a front portion of the rack rim 1058. Correspondingly, rear ends 1064 of the support wires 1060 are welded or otherwise connected to a rear portion 1070 of the rack rim 1058. In the case of the can rack 1056, the support wires 1060 are slanted downwardly from the rear to the front portion of the can rack 1056. This is for purposes of supporting beverages or other articles and cans in a manner so that regardless of the number of cans in the can rack 1056, a can will always be positioned within the forward-most portion of the can rack 1056 (i.e., nearest the refrigerator door).

The rack rim 1058 also includes a left portion 1066. Projecting downwardly from the left portion 1066 are two pairs of downwardly projecting support stubs 1068. As shown particularly in FIGS. 43 and 44, the downwardly projecting support stubs 1068 are releaseably captured within the inserts 1050 previously described herein and connected to the right side member 1038. Correspondingly, an insert 1050 is positioned on the frontal surface of the rear bracket extension 1044. A further pair of downwardly projecting support stubs 1068 projects downwardly from the rear portion 1070 of the rack rim 1058 and are releaseably captured within the insert 1050 associated with the rear bracket extension 1044.

Figure 45:
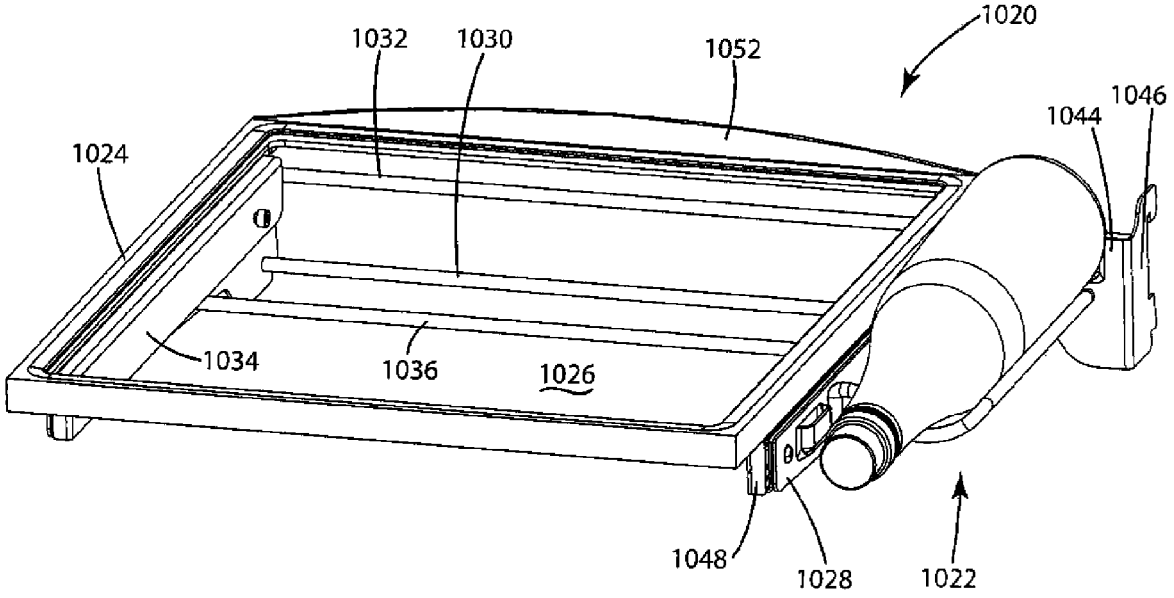
FIG. 45 is a perspective view of the refrigerator shelf and storage rack.
Figure 47:
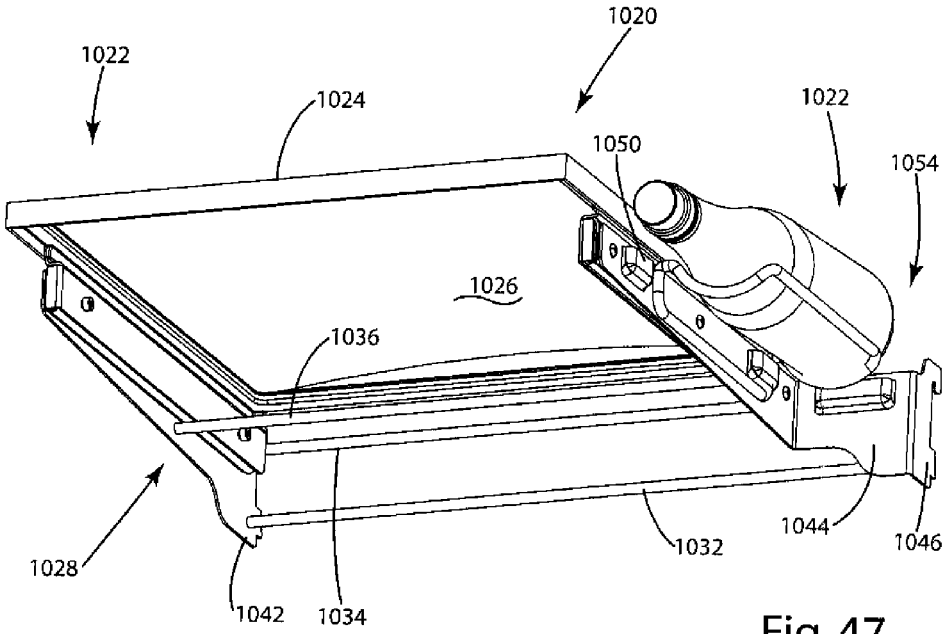
FIG. 47 is an underside, perspective view of a refrigerator shelf, showing the shelf in a substantially retracted position, and showing the use of a wine rack to the side of the shelf.
Figure 48:
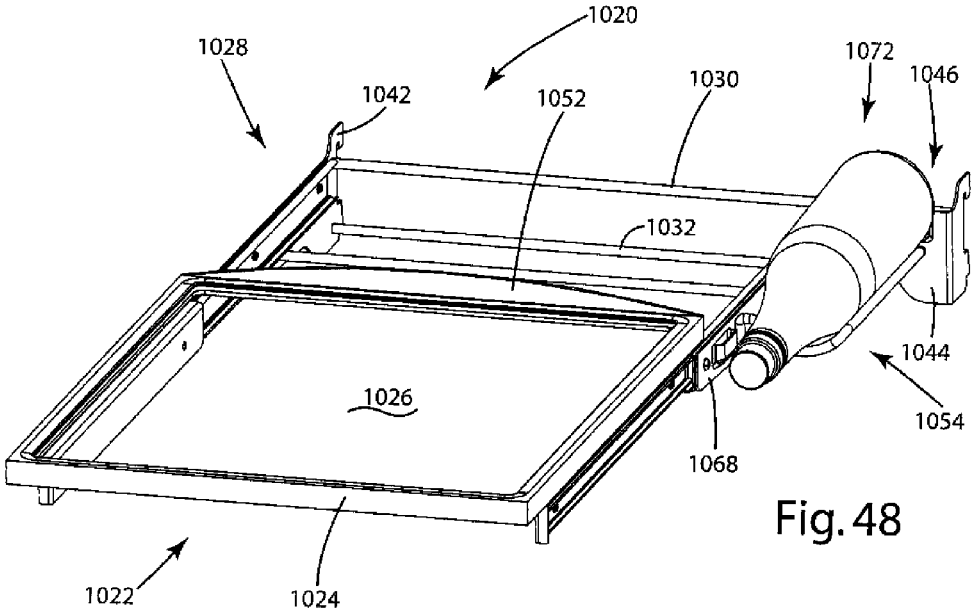
FIG. 48 is an upside perspective view of the refrigerator shelf in FIG. 47, but with the shelf in an extended position.
Figure 49:
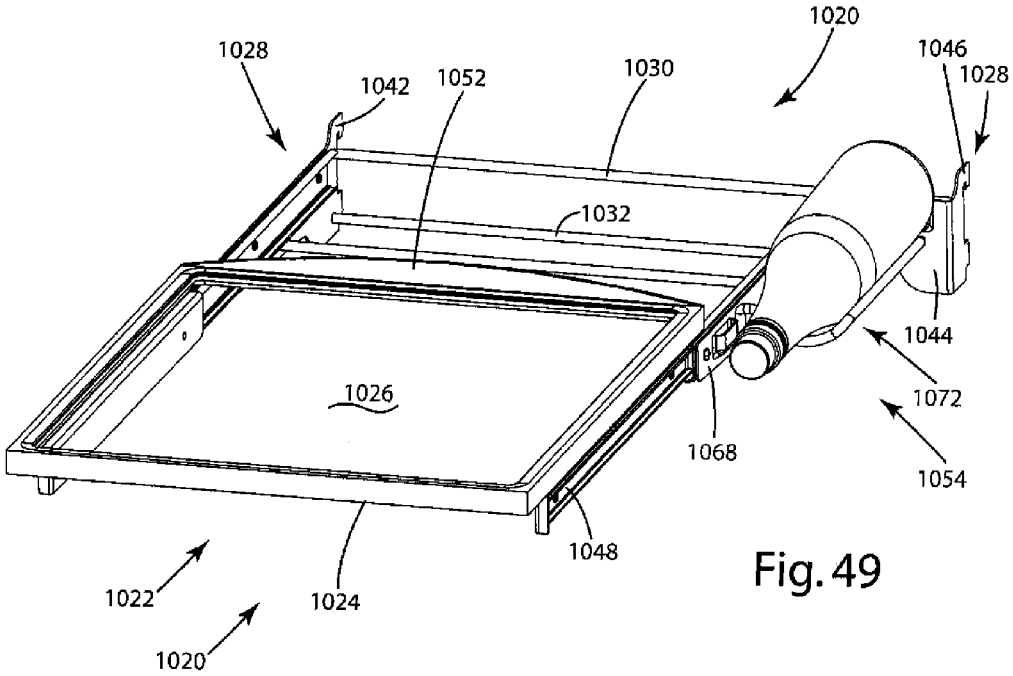
FIG. 49 is a view similar to FIG. 48, but showing the refrigerator shelf in a partially extended position.

As earlier mentioned, various types of racks 1054 may be utilized in accordance with the invention. For example, FIG. 45 illustrates the use of a wine rack 1072, for purposes of appropriately holding a bottle of wine in the space vacated by the shelf assembly 1020 in view of the rear bracket extension 1044. FIGS. 47, 48 and 49 show various views and various slided positions of the refrigerator shelf 1022 relative to the cantilever frame 1028, with a wine rack 1072.

Figure 46:
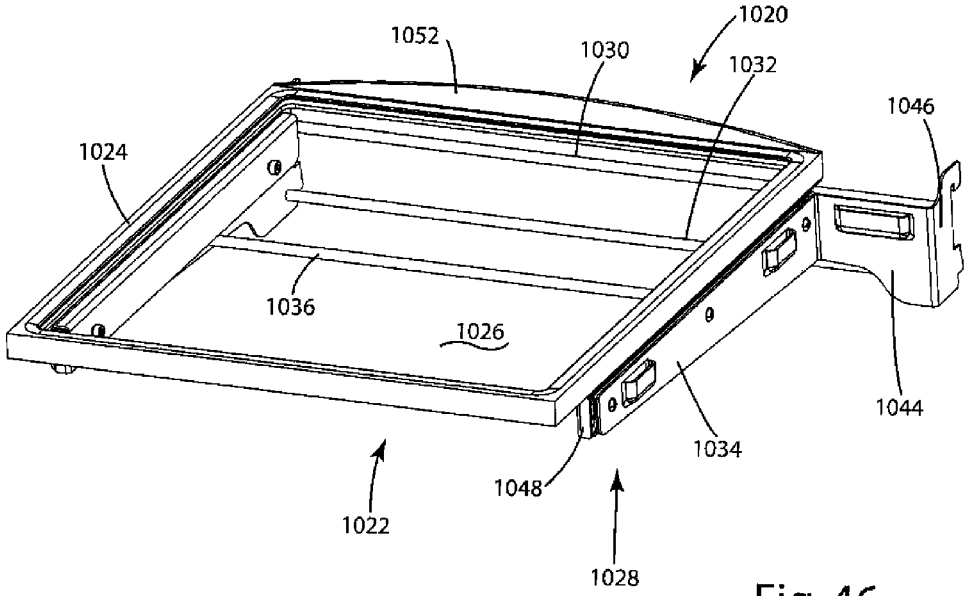
FIG. 46 is an upside perspective view of a refrigerator shelf, showing the shelf in a retracted position and showing the area for add-on features on one side of the shelf.
Figure 50:
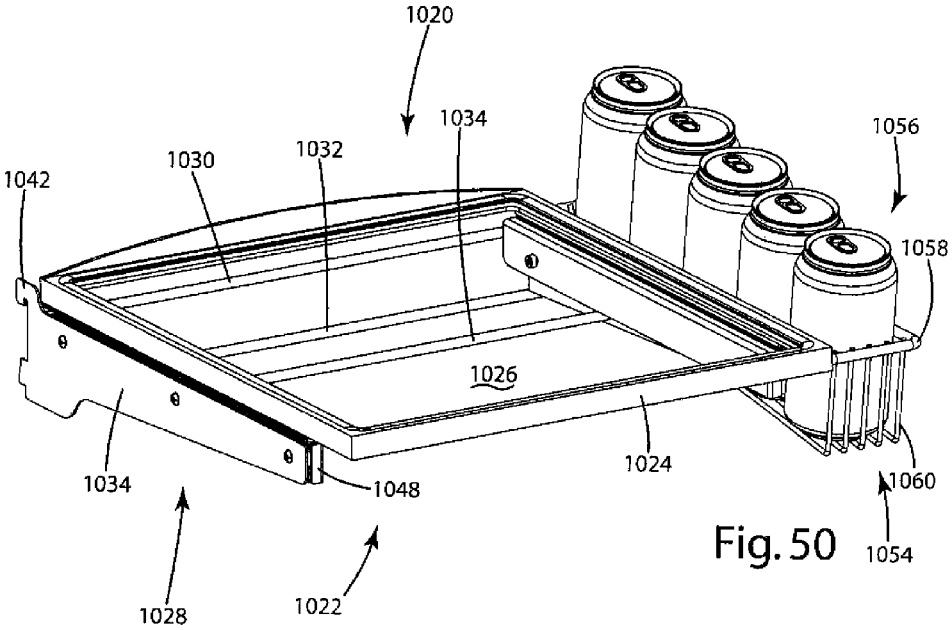
FIG. 50 is a left side perspective view of a refrigerator shelf, showing the shelf utilized with a can rack.
Figure 51:
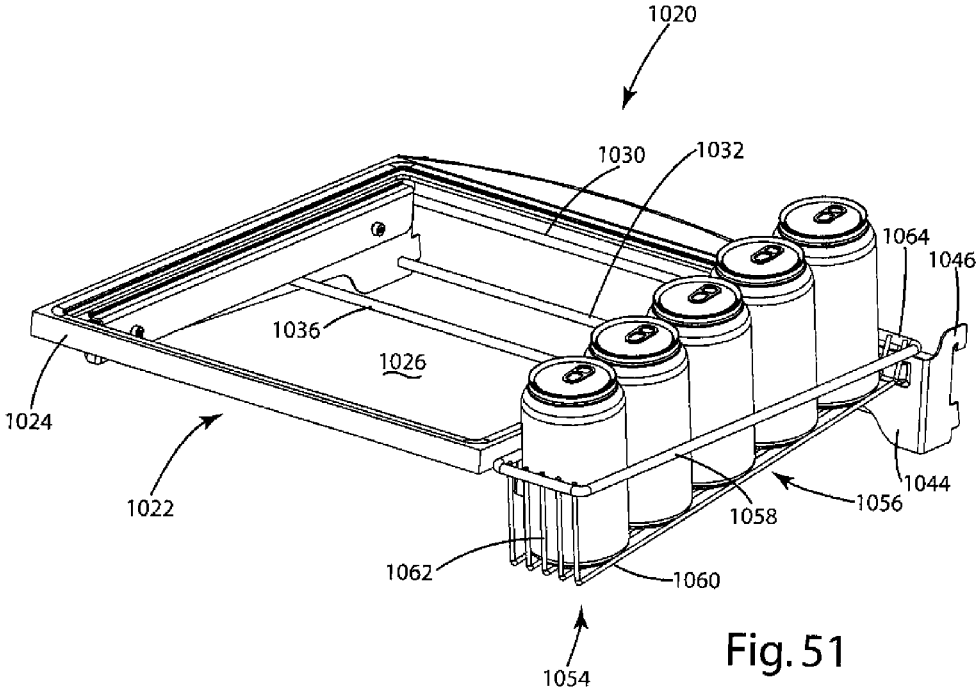
FIG. 51 is a right side perspective view of the refrigerator shelf and can rack shown in FIG. 50.
Figure 52:
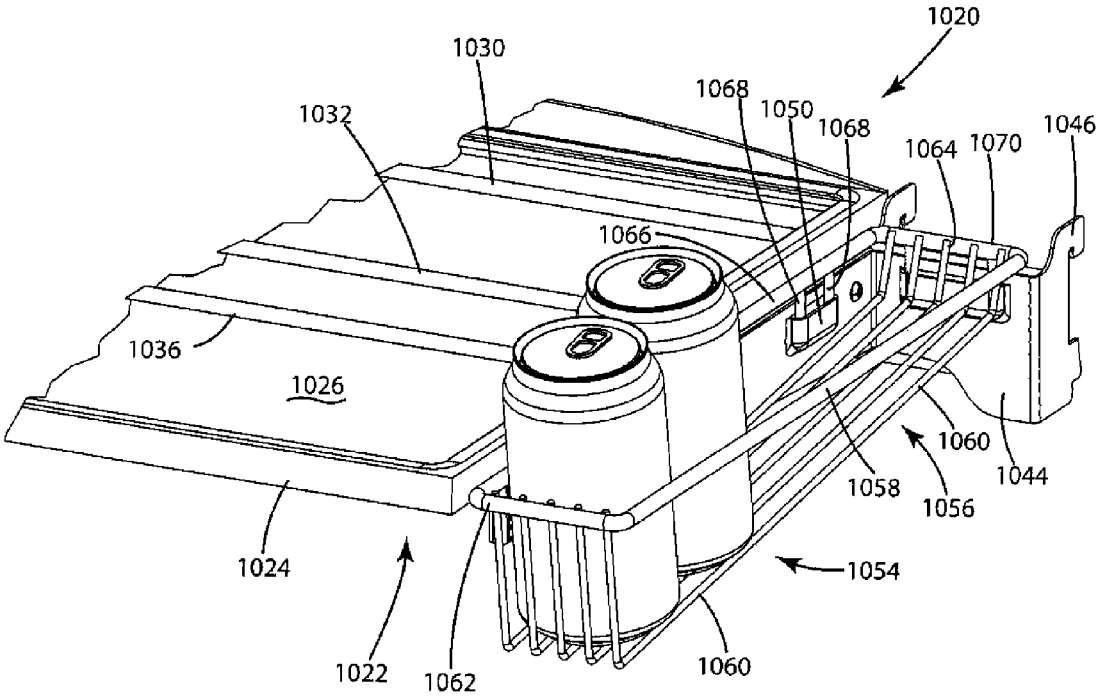
FIG. 52 is a partial and close-up right side perspective view of the refrigerator shelf shown in FIG. 51, but showing the can rack with a pair of the cans removed so as to show formed areas on the side arm which allow for different types of inserts on the right side of the shelf.

FIG. 46 illustrates a shelf assembly 1020 with the complete absence of any type of rack 1054. The area in front of the rear bracket extension 1044, as previously mentioned, can be utilized for various features. In addition to the can rack and wine rack previously described herein, this area can be utilized for a bread shelf, large bottle holder, condiment tray, removable basket, pill bottles, plastic salad bin (with or without a lid) and various other assemblies. FIGS. 50 and 51 illustrate various perspective views of the shelf assembly 1020 with the can rack 1056. FIG. 52 illustrates the can rack 1056 with the rack 1056 partially empty in that only two cans are being supported within the rack 1056.

Figure 53:
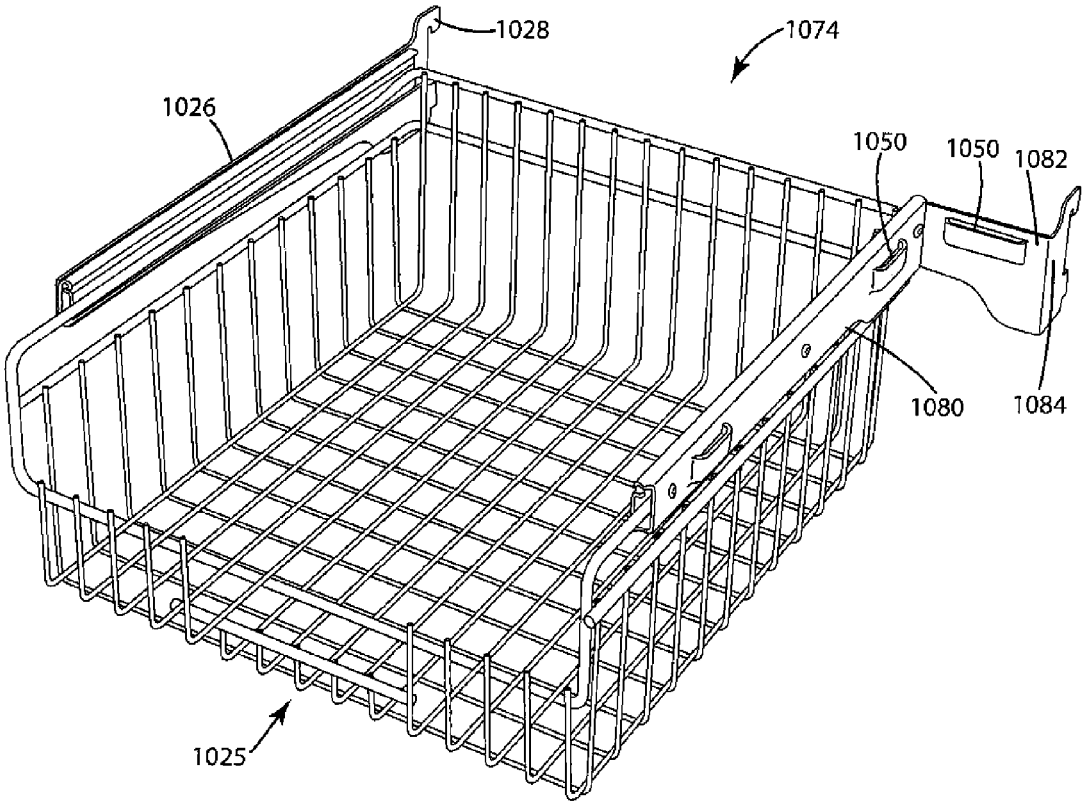
FIG. 53 is a perspective view of a refrigerator basket.

In addition to the concept of the shelf assembly 1020 with a rack 1054, the same concept can be applied to a refrigerator basket assembly. Such a basket assembly is illustrated as basket assembly 1074 in FIG. 53 in perspective view. The majority of the components of the basket assembly 1074 are conventional in structure and nature, and will not be described in any detail herein. With reference to FIG. 53, the basket assembly 1074 is supported through the use of a left side arm 1076. The left side arm 1076 includes a left side hanger set 1078 integral therewith at the rear portion of the side arm 1076. The side arm 1076 can include components which provide for a slidable engagement between the side arm 1076 and the basket 1075 of the basket assembly 1074.

In addition to the left side arm 1076, the basket assembly 1074 also includes a right side arm 1080. The right side arm

1080 will also include appropriate components to provide for a slidable engagement with the basket 1075. Coupled in any suitable manner to the rear portion of the side arm 1080 or the rear portion of the basket 1075 is a right side rear bracket extension 1082. The rear bracket extension 1082 corresponds in function to the rear bracket extension 1044 associated with the shelf assembly 1020. Extending rearwardly from the rear bracket extension 1082 is a right side hanger set 1084. The rear bracket extension 1082 provides, like the rear bracket extension 1044, the advantageous feature of the basket assembly 1074 being offset. This will prevent the front portion of the basket 1075 from abutting or otherwise being interfered with forward movement by components of the refrigerator door. Still further, the right side arm 1080 and the front surface of the rear bracket extension 1082 include inserts 1050, similar in structure and function to the inserts 1050 of the shelf assembly 1020. Accordingly, racks or other types of devices (such as those previously described herein) may be releaseably positioned within the vacant area provided by the offset of the basket assembly 1074. It should be emphasized that other types of structures may be utilized for a basket or similar means employed within a refrigerator for holding food and beverage articles, without departing from the spirit and scope of the novel concepts of the invention.

It will be apparent to those skilled in the pertinent arts that other embodiments of shelving and basket assemblies in accordance with the invention may be designed. That is, the principles of shelving assemblies and basket assemblies in accordance with the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

What is claimed is:

1. A shelf assembly in a refrigerator or similar enclosure having first and second sides, and a rear defining an interior, said shelf assembly comprising:

at least one shelf secured within an interior of said refrigerator so as to be movable between a retracted position and an extended position, for purposes of facilitating placement and removal of articles on said shelf by a user;

a cantilever frame secured in a stationary manner within said refrigerator interior and coupled to said refrigerator shelf so as to slidably support said shelf as said shelf moves between said retracted position and said extended position, said cantilever frame comprising first and second opposing sideplates;

said first sideplate provided adjacent the first side of the refrigerator and having first side hangar means, for purposes of removably securing said cantilever frame to said refrigerator interior;

said second sideplate being substantially L-shaped, having a first portion extending substantially parallel to said first sideplate and a second side rear bracket extension portion extending from a rear end of the first portion away from first said sideplate to provide for an offset of said refrigerator shelf from said second side of said refrigerator interior;

said second side rear bracket extension is sized and configured so as to provide for said offset so that when said refrigerator shelf is extended forwardly relative to said cantilever frame, a front end of said refrigerator shelf will not abut or otherwise be interfered with by any portion of a door of said refrigerator, when said door is in an open position; and said second side rear bracket extension is further sized and configured so that said offset provides for a functional space between said second side of said shelf assembly and said second side of said refrigerator interior, said functional space remaining stationary in position when said shelf extends forwardly relative to said cantilever frame, and said functional space provides for interchangeability of functional components within said functional space.

2. A shelf assembly in accordance with claim 1, characterized in that said shelf assembly further comprises a rack positioned adjacent said second side of said shelf and within said functional space, for purposes of storing various types of food and beverage articles.

3. A shelf assembly in accordance with claim 2, characterized in that said rack comprises a can rack having a rectangular and horizontally disposed configuration.

4. A shelf assembly in accordance with claim 3, characterized in that said can rack includes a set of support wires having a substantially parallel configuration, with said support wires extending downwardly from a rear portion to a front portion of said can rack, so that a can will always be positioned within the forward most portion of said can rack.

5. A shelf assembly in accordance with claim 2, characterized in that said rack comprises a wine rack.

6. A basket assembly in a refrigerator or similar enclosure having first and second sides, and a rear defining an interior, said basket assembly comprising:

at least one basket secured within an interior of said refrigerator so as to be movable between a retracted position and an extended position, for purposes of facilitating placement and removal of articles within said basket by a user;

a first side arm provided adjacent the first side of the refrigerator and having a first side hanger set positioned at a rear portion of said first side arm, with said first side hanger set removably coupled to an interior of said refrigerator, said first side arm providing for a slidable engagement between said side arm and said basket;

a second side arm coupled to said basket for providing a slidable engagement with said basket;

said second side arm being substantially L-shaped, having a first portion extending substantially parallel to said first side arm and a second side rear bracket extension extending from a rear end of said first portion away from said first side arm to provide for an offset of said basket from said second side of said refrigerator interior;

a second side hanger set connected to said second side rear bracket extension and removably coupled to said refrigerator interior; and said offset of said basket relative to said one side of said refrigerator prevents a front portion of said basket from otherwise being interfered with forward movement by components of a door of said refrigerator; and said second side rear bracket extension is sized and configured so that said offset of said basket provides for a functional space existing between said basket and said second side of said refrigerator interior, said offset remaining stationary in position during extension of said basket.

* * * * *